US006860779B2

(12) United States Patent
Fujimura et al.

(10) Patent No.: US 6,860,779 B2
(45) Date of Patent: Mar. 1, 2005

(54) METHOD FOR MANUFACTURING AIRTIGHT VESSEL AND IMAGE-FORMING APPARATUS USING AIRTIGHT VESSEL

(75) Inventors: Hidehiko Fujimura, Yokohama (JP); Toru Aruga, Yokohama (JP); Masaaki Ogura, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/309,766

(22) Filed: May 11, 1999

(65) Prior Publication Data

US 2002/0042240 A1 Apr. 11, 2002

(30) Foreign Application Priority Data

May 18, 1998 (JP) ..... 10-135563
Apr. 12, 1999 (JP) ..... 11-103955

(51) Int. Cl.[7] ..... H01J 9/26
(52) U.S. Cl. ..... 445/25; 445/40; 445/41
(58) Field of Search ..... 445/40, 41, 25, 445/24

(56) References Cited

U.S. PATENT DOCUMENTS

| | | | | | |
|---|---|---|---|---|---|
| 2,714,785 | A | * | 8/1955 | Roovers | 445/53 |
| 4,045,849 | A | | 9/1977 | Thall | 29/25.13 |
| 5,520,563 | A | * | 5/1996 | Wallace et al. | 445/24 |
| 5,681,198 | A | | 10/1997 | Peng et al. | 445/43 |
| 5,688,708 | A | * | 11/1997 | Kato et al. | 445/41 |
| 5,697,825 | A | * | 12/1997 | Dynka et al. | 445/25 |
| 5,760,538 | A | | 6/1998 | Mitsutake et al. | 313/422 |
| 5,925,979 | A | | 7/1999 | Azuma et al. | 313/495 |
| 5,952,775 | A | | 9/1999 | Sato et al. | 313/422 |

FOREIGN PATENT DOCUMENTS

| | | | |
|---|---|---|---|
| EP | 0 690 472 | | 1/1996 |
| EP | 732721 | * | 9/1996 |
| EP | 0 780 875 | | 6/1997 |
| JP | 53-64461 | | 6/1978 |
| JP | 7-296731 | | 11/1995 |
| JP | 7-296731 A | * | 11/1995 |
| JP | 7-296748 | | 11/1995 |
| JP | 7-302545 | | 11/1995 |
| JP | 8-171871 | | 7/1996 |
| JP | 10-134721 | | 5/1998 |
| JP | 10-283930 | | 10/1998 |
| KR | 93-11091 | | 6/1993 |
| KR | 1999-027714 | | 4/1999 |
| KR | 10-0220357 | | 6/1999 |
| WO | WO 98/264443 | | 6/1998 |

OTHER PUBLICATIONS

**A full Translation of Banno et al was submitted by applicants on Jan. 20, 2002.*

W.P. Dyke, et al., "Field Emission", Advances in Electronics and Electron Physics, pp. 90–185 (1956).

C.A. Spindt, et al., "Physical Properties of Thin–Film Field Emission Cathodes with Molybdenum Cones", Journal of Applied Physics, vol. 47, No. 12, pp. 5248–5263 (D cemb r 1976).

C.A. Mead, "Operation of Tunnel–Emission Devices", Journal of Applied Physics, vol. 32, No. 4, pp. 646–652 (Apr. 1961).

(List continued on next page.)

*Primary Examiner*—Kenneth J. Ramsey
(74) *Attorney, Agent, or Firm*—Fitzpatrick, Cella, Harper & Scinto

(57) ABSTRACT

A method for manufacturing an airtight vessel seals an evacuation tube after evacuating the inside of the vessel using the evacuation tube. A getter previously disposed in the vessel is activated followed by fusing a part of the evacuation tube to seal the vessel while heating the vessel.

1 Claim, 19 Drawing Sheets

OTHER PUBLICATIONS

M.I. Elinson, et al., "The Emission of Hot Electrons and the Field Emission of Electrons From Tin Oxide", Radio Engineering and Electronic Physics, No. 7, pp. 1290–1296 (Jul. 1965).

G. Dittmer, "Electrical Conduction and Electron Emission of Discontinous Thin Films", Thin Solid Films, vol. 9, pp. 317–328 (1972).

H. Araki, et al., "Electroforming and Electron Emission of Carbon Thin Films", Journal of Vacuum Society of Japan, vol. 26, No. 1, pp. 22–29 (Jan. 1983).

M. Hartwell, et al., "Strong Electron Emission From Patterned Tin–Indium Oxide Thin Films", International Electron Devices Meeting, pp. 519–521 (1975).

* cited by examiner

ADSORPTION CHARACTERISTICS OF NONEVAPORABLE GETTER ($H_2O$)

METHOD FOR MANUFACTURING AIRTIGHT VESSEL AND IMAGE-FORMING APPARATUS USING AIRTIGHT VESSEL

BACKGROUND OF THE INVENTION

1. Field of the Invention

The present invention relates to a method for manufacturing an airtight vessel. The present invention especially relates to a method for evacuating gases discharged while sealing an evacuation tube in the method for manufacturing the airtight vessel to be used for an image-forming apparatus.

2. Description of Related Art

Electron emission elements known in the art have been mainly categorized into a thermionic-cathode and a cold-cathode. The cold-cathode include a field emission type (referred to FE-type hereinafter), metal/insulation layer/metal type (referred to MIM-type hereinafter) and surface conduction type electron emission elements.

Examples of the FE-type electron emission elements are disclosed by W. P. Dyke and W. W. Dolan in "Field Emission", Advance in Electron Physics, 8, 89 (1956) or by C. A. Spindt in "Physical Properties of Thin-film Field Emission Cathodes with Molybdenum Cones", J. Appl. Phys., 47, 5248 (1976).

Examples of the MIM-type electron emission elements are disclosed by C. A. Mead in "Operation of Tunnel-Emission Devices", J. Appl. Phys., 32, 646 (1961).

Examples of the surface conduction type electron emission elements are disclosed by M. I. Elinson in Radio Eng. Electron Phys., 10, 1290, (1965).

The surface conduction type electron emission element makes use of a phenomenon in which electrons are emitted by allowing an electric current to flow through a small area thin film formed on a substrate parallel to the film surface. Elements using a $SnO_2$ thin film (Elinon et. al.), using an Au thin film (G. Dittmer, "Thin Solid Films", 9, 317, 1972), using an $In_2O_3/SnO_2$ thin film (M. Hartwell and C. G. Fonstad, IEEE Trans., ED Conf., 519, 1975) and using a carbon thin film (Hisashi Araki et, al., Shinku (Vacuum), 26, 1, p22, 1983) are reported as this surface conduction type electron emission element.

Flat panel display devices that make fluorescent films to undergo light emission by an electron beam projected out of these cold-cathode electron emission elements have been developed.

The foregoing display device requires an ultra-high vacuum in order to steadily operate the cold-cathode electron emission element for a long period of time. The display device is composed of an airtight vessel in which a frame is inserted between a substrate having a plurality of electron emission elements and a confronting substrate having fluorescent films, and the vessel is sealed by a method to be described hereinafter.

In order to manufacture an airtight vessel inside of which maintains a high vacuum as described above, the inside of the vessel is at first evacuated with a vacuum pump through an evacuation tube connected to the vessel in the conventional art. Inside of the vessel is then sufficiently degassed by a baking step by keeping the vessel at a high temperature of 300 to 350° C. for several hours. After cooling the vessel to room temperature, an evaporable getter placed in the vessel and mainly composed of Ba is heated with microwave or by flowing an electric current to form a getter film by allowing the Ba-containing getter to evaporate (referred to getter flash hereinafter). The airtight vessel is cut off from the evacuation tube after sealing a part of the evacuation tube connected to the vacuum pump by heat-fusion. Vacuum in the airtight vessel is maintained with the getter film.

The method for maintaining an ultra-high vacuum in the vessel is disclosed, for example, in Japanese Patent Laid-Open No. 7-302545. In this method, gases adsorbed at interior surfaces of the display device can be readily discharged by repeating the step for introducing and holding the gas into the display device while baking the inside of the display device after evacuation followed by repeating the evacuation steps of the display device several times, thereby enabling to reduce the amount of adsorbed gases in the display device to maintain an ultra-high vacuum in the display device.

Japanese Patent Laid-Open No. 7-296748 also discloses the steps of readily degassing the inside of the vessel by baking the vessel, activating the getter disposed in the evacuation tube and forming an airtight vessel by sealing the evacuation tube. Either a evaporable getter or nonevaporable getter may be used as a getter.

Japanese Patent Laid-Open No. 7-296731 discloses a different sealing method. According to the patent publication above, an airtight vessel is obtained by sealing the evacuation tube after heating the tube at a temperature higher than the temperature for heating the vessel during the baking step of the vessel.

However, there have been problems as described below for maintaining a vacuum with the foregoing getter.

The pressure P in the airtight vessel is represented by an equation "P=Q/S", wherein Q is the amount of discharged gas from the surface of the vessel and S is an effective evacuation rate. The effective evacuation rate is determined by the configuration of the airtight vessel, position of the getter and evacuation rate of the getter. In other words, when the configuration of the airtight vessel, the position of the getter and the evacuation rate of the getter are fixed, the amount of discharged gas Q in the airtight vessel should be diminished in order to reduce the gas pressure in the airtight vessel as low as possible. A sufficient degassing treatment such as the baking treatment is necessary for this purpose prior to the sealing step. However, gases are discharged again during the sealing step.

The amount of the discharged gas is about $5\times10^{-7}$ to $1\times10^{-5}$ $Pa\cdot m^3$, and the main component of the discharged gas is water. In the gases generated by sealing, it is conjectured that substances incorporated into the glass constituting the evacuation tube are discharged from the glass by being heated above its softening point during sealing of the evacuation tube. Most of the gases discharged by sealing are trapped in the airtight vessel, again contaminating the room of the airtight vessel that has been once cleaned by the baking step.

The gases generated form the evacuation tube during sealing are removed by the getter disposed in the evacuation tube according to Japanese Patent Laid-Open No. 7-296748 cited above. However, such a construction makes evacuation time of the vessel too long or the diameter of the evacuation tube itself should be large owing to the getter in the evacuation tube.

When the diameter of the evacuation tube is large, sealing it becomes difficult thus failing to maintain the performance of the airtight vessel.

Impurities such as water, oxygen and CO should be reduced to as small as possible in the flat type image display device making use of the field emission type electron emission element and surface conduction type electron emission element in order to stabilize electron emission characteristics of electron sources. Accordingly, the evacuation method as hitherto described had a drawback that the electron emission characteristics of the electron sources are not stabilized owing to impurities discharged in the sealing step, thereby decreasing the life span of the device.

SUMMARY OF THE INVENTION

The object of the present invention is to provide a method for manufacturing an image-forming apparatus with a long life and provided with electron emission elements that are free from the foregoing problems and can steadily operate for a long period of time.

Another object of the present invention is to provide a method for manufacturing an airtight vessel by removing gases discharged while sealing the evacuation tube for evacuating the inside of the vessel.

According to one aspect of the present invention, the airtight vessel is manufactured by sealing the evacuation tube connected to the vessel for evacuating the vessel with heating while the getter disposed in the vessel is activated.

The vessel according to the present invention corresponds to a vessel, the inside and outside of which are interconnected with each other via the evacuation tube.

The airtight vessel according to the present invention corresponds, on the other hand, to a vessel inside of which is shut down from outside by sealing the evacuation tube connected to the vessel.

The construction as described above suppress gases such as water and oxygen discharged at a temperature above the softening point of the constituting material of the evacuation tube from being absorbed into the inner wall of the vessel, along with eliminating the foregoing gases discharged from the evacuation tube with the previously activated getter. Accordingly, contamination of the inside of the vessel with the gases discharged from the evacuation tube is suppressed, allowing the vessel to promptly establish and maintain a high vacuum.

The getter to be activated prior to sealing the evacuation tube may be either an evaporable getter or a nonevaporable getter. Activation of the getter denotes, in the case of a evaporable getter using Ba for example, to form a Ba film (a getter film) on the inside wall of the vessel by flashing the getter.

As is evident from the foregoing description, heating of the vessel during the sealing step is essential in the present invention. Therefore, the nonevaporable getter having better heat resistance than the evaporable getter is preferable as a getter to be activated prior to sealing in the present invention.

A part of the evacuation tube as a constituting member of the airtight vessel is left behind after the sealing step of the tube. Accordingly, it is preferable to seal the evacuation tube while heating it from the seal point through the connection point in order to prevent the gases discharged during the sealing step from absorbing on the inner wall of the evacuation tube left behind at the airtight vessel side.

The evacuation tube is preferably sealed while evacuating the inside of the vessel by connecting the evacuation tube to the vacuum pump, because the gases discharged during the sealing process of the evacuation tube should be evacuated with the vacuum pump as soon as possible.

It is also preferable in the present invention that the evacuation tube is connected to the vacuum pump while heating the vessel before sealing the evacuation tube in order to degas with heating by evacuating the inside of the vessel.

The vessel is preferably degassed with heating prior to activating the getter.

The vessel is also preferably degassed continuously with heating during activation of the getter, mainly because the gases discharged from the getter while it is activated are not absorbed on the inner wall of the vessel but are readily evacuated out of the vessel with the vacuum pump. Also, melting and heat-deformation of the glass constituting the vessel is suppressed in the process described above by reducing the temperature difference between the vessel and the getter, since the temperature required for sufficiently activating the getter is 500° C. or more when the nonevaporable type getter is used for the getter. It is preferable, on the other hand, to activate the getter before heat-degassing of the vessel in order to evacuate the gas discharged during heat-degassing of the inner wall of the vessel as soon as possible.

It is also preferable that the heating temperature in the heat-degassing step is approximately equal to the heating temperature of the vessel in the sealing step, since productivity is improved and the production cost is reduced by avoiding to repeat increase and decrease of the heating temperature during the production process.

The preferable heating temperature during the sealing step is 100° C. or more.

When the nonevaporable getter is used for the getter, it may be re-activated after the sealing step, in order to re-activate the surface of the nonevaporable getter that has been contaminated in the sealing step, thereby making it possible to keep a higher vacuum for a prolonged period of time after sealing.

When the nonevaporable getter is used for the getter to be activated prior to sealing, the evaporable getter is also preferably used together. In this case, however, the getter film formed by activating the evaporable getter (getter flash) may lose its getter characteristics if the getter film is exposed to a high temperature. Therefore, it is preferable to activate (getter flash) the evaporable getter after sealing while the temperature of the vessel is sufficiently cooled down.

The evaporable getter is preferably degassed by heating prior to activating the evaporable getter. This degassing step is preferably executed prior to the sealing step, because the gases discharged during the activation step of the evaporable getter (getter flash) after sealing can be suppressed, enabling to maintain a high vacuum for a long period of time.

A long life image-forming apparatus in which characteristics of the electron emission elements are less deteriorated by the remaining gases in the airtight vessel can be obtained by applying the manufacturing method as hitherto described to the method for manufacturing the image-forming apparatus comprising the electron emission elements and image-forming members for forming images by the electrons emitted from the electron emission elements in the airtight vessel.

The cold cathode electron emission element such as the field emission type electron emission element, MIM type electron emission element and surface conduction type electron emission element are preferably used for the electron emission elements. The present invention is especially effective for the image-forming apparatus using the electron emission element comprising a carbon film whose electron emission characteristics are remarkably deteriorated by oxygen and water, being more effective for the image-forming apparatus using the surface conduction type electron emission element comprising the carbon film. However, the present invention is by no means limited to these elements.

DETAILED DESCRIPTION OF THE PREFERRED EMBODIMENTS

Figure 1:
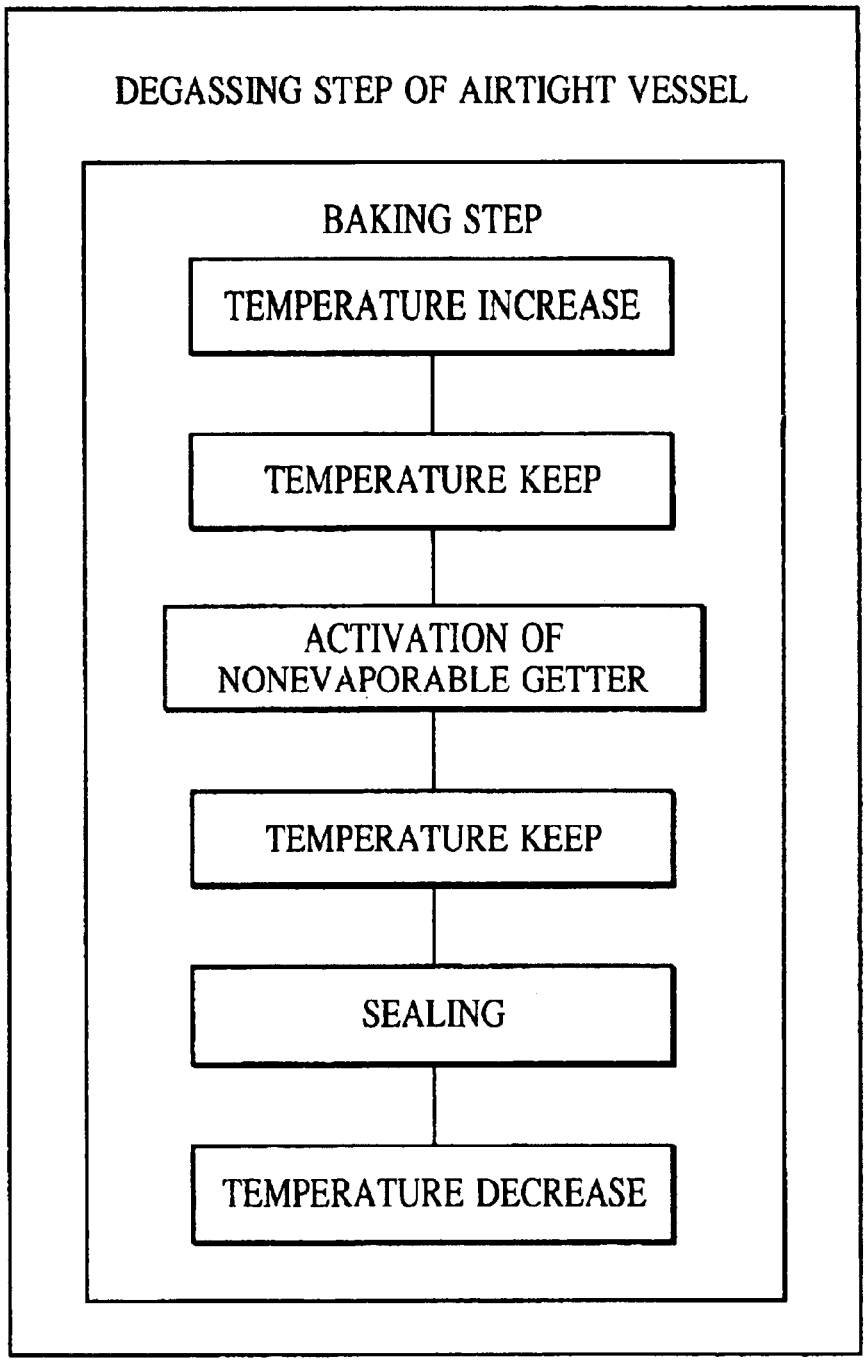
FIG. 1 shows a flow chart of the degassing step in Example 1.

Although details of the present invention will be described referring to the drawings, the present invention is by no means restricted to these descriptions.

EXAMPLE 1

Figure 2:
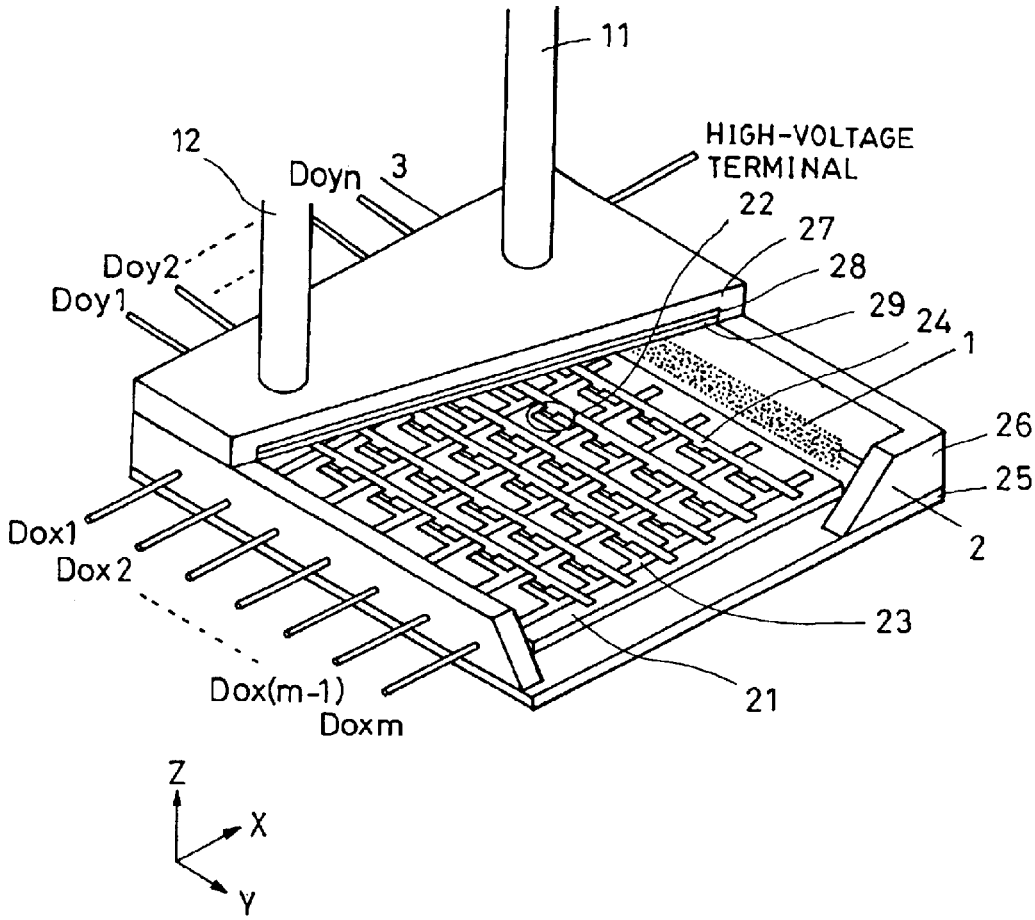
FIG. 2 is a perspective view showing an outline of the image-forming apparatus making use of the surface conduction type electron emission element.

The image-forming apparatus having a construction as shown in FIG. 2 was manufactured. A plurality of surface conduction type electron emission elements—one kind of cold cathode electron emission elements—were formed on the rear plates in this example. fluorescent films were provided on the face plate and a color image-forming apparatus with an effective display area having a diagonal length of 15 inches and vertical to transverse length ratio of 3:4 was manufactured.

The image-forming apparatus according to this example will be described referring to FIG. 2.

FIG. 2 is a perspective view showing the outline of the image-forming apparatus used in this example, in which a part of the panel is cut off to show the internal structure.

The reference numerals 25, 26 and 27 in the drawing correspond to a rear plate, a supporting frame and a face plate, respectively, forming a vessel for maintaining vacuum in the display panel. A sealing bonding step is required in order to endow junction among respective members with sufficient strength and airtight property in assembling the vessel.

The reference numerals 11 and 12 in the drawing denote the evacuation tubes for connecting the vessel to the vacuum pump when the inside of the vessel is evacuated. These evacuation tubes can be utilized as gas-inlet tubes of activation gases when the activation process is executed after the vessel has been assembled.

A miniature gauge (a total pressure gauge, not shown in the drawing) is attached at the tip of the evacuation tube 11 for evaluating the effectiveness of this example by measuring the pressure in the panel.

The reference numeral 1 in the drawing shows a nonevaporable getter for maintaining vacuum in the airtight vessel after sealing the evacuation tube. The reference numerals 2 and 3 shows electric current input-output terminals for flowing an electric current to the nonevaporable getter. While a nonevaporable getter containing Ti as a main component and comprising Zr, V and Fe was used in this example, a nonevaporable getter containing Zr as a main component may be used.

Figure 4:
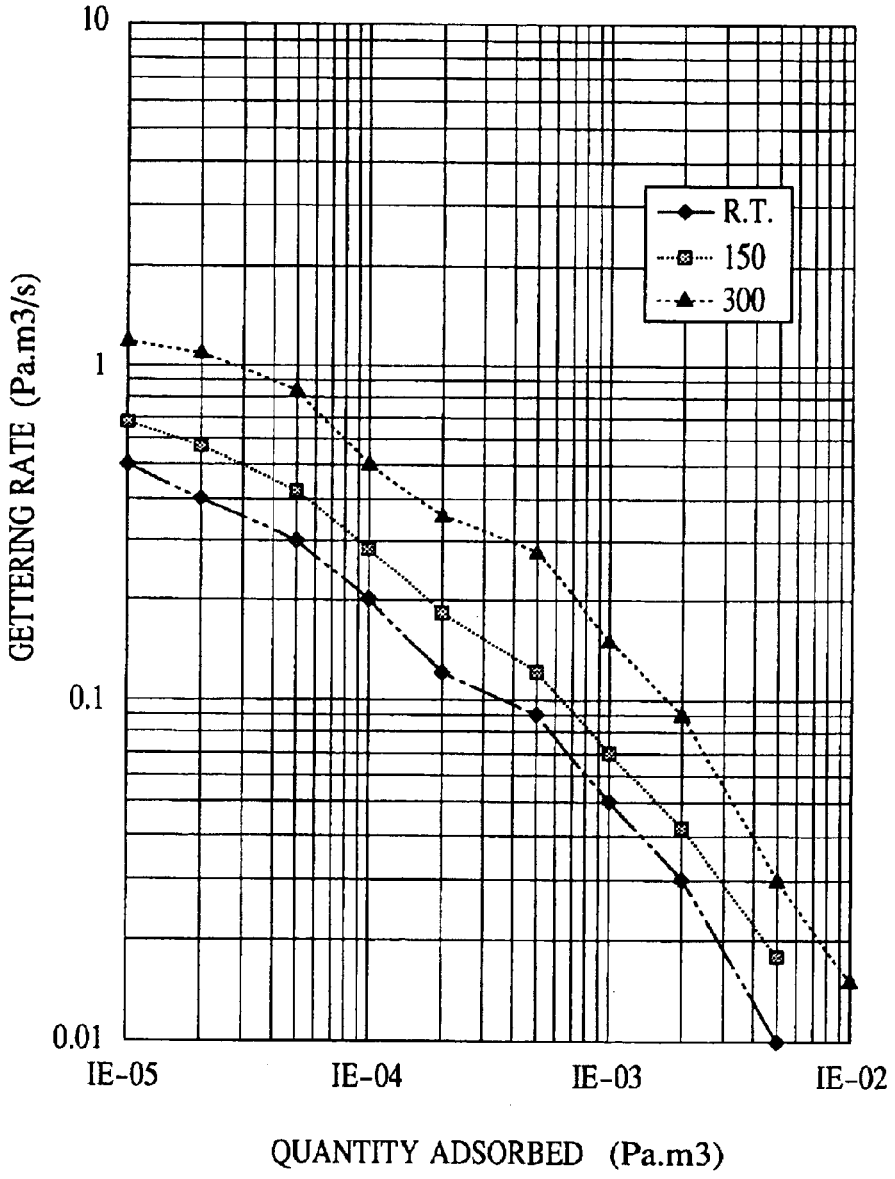
FIG. 4 is a graph showing the relation between the absorption characteristics per arbitrary unit area of the nonevaporable getter and temperature.

The $H_2O$ absorption characteristics of the nonevaporable getter used in this example is shown in FIG. 4. The vertical and horizontal axes denote an evacuation rate and amount of absorption, respectively. A through-put method was used for the measurement. Characteristics of the nonevaporable getter at room temperature (R. T.), 150° C. and 300° C. are shown in the graph.

It is evident from the graph that the adsorption rate and the amount of adsorption is increased as the temperature becomes higher in the nonevaporable getter, confirming that the getter used in this example has good evacuation characteristics at high temperature.

N×M pieces of the surface conduction type emission elements 22 (wherein N and M are integers of two or more which are appropriately selected according to the required number of pixels) are formed on the rear plate 25 to construct a multi-beam source.

M strings of wiring along the row direction (named as lower wiring) and N strings of wiring along the column direction (named as upper wiring) form a matrix for the N×M pieces of the surface conduction type emission element.

Figure 3A:
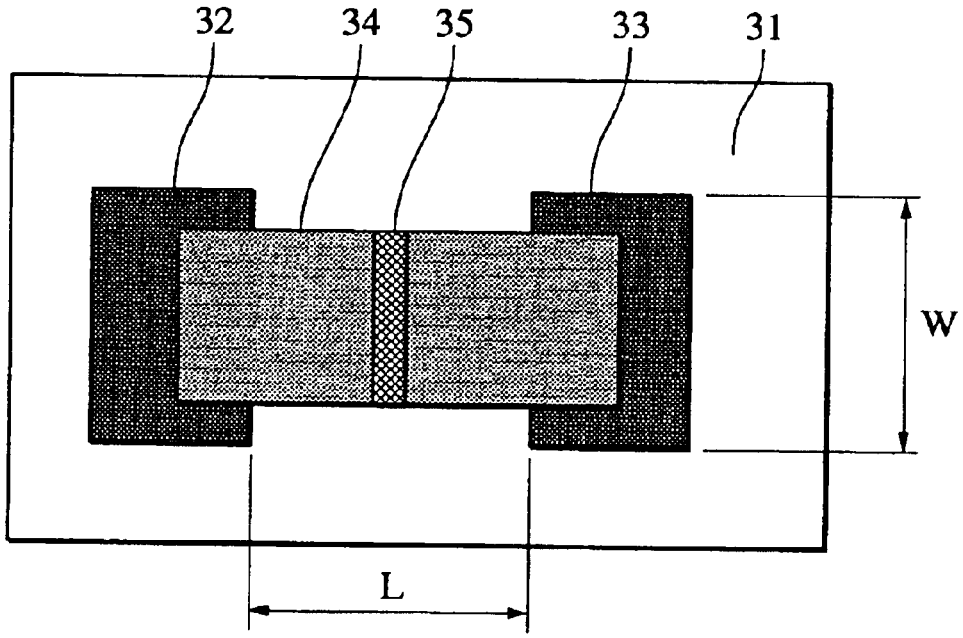
FIGS. 3A and 3B are illustrative drawings showing the construction of the surface conduction type electron emission element.
Figure 3B:
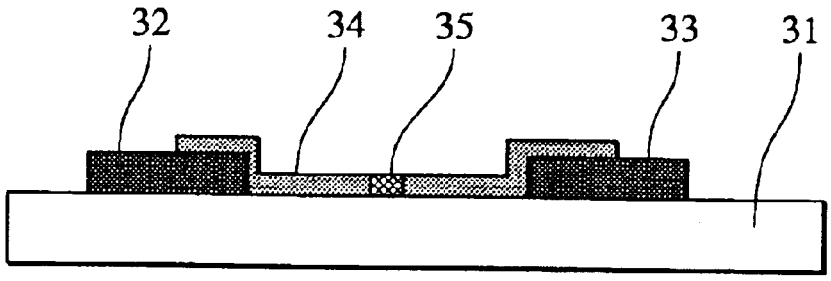

FIG. 3A is a top plane view and FIG. 3B is a cross-section view showing the construction of the surface conduction type electron emission element. The reference numerals 31, 32 and 33, 34 and 35 in the figures denote a substrate, electrodes, conductive film and an electron emission part, respectively.

As shown in FIG. 2, fluorescent films 28 are formed on the bottom face of the face plate 27. Since the color display device is used in this example, fluorescent substances with R (red), G (green) and B (blue) three primary colors used in CRT are separately coated on the respective fluorescent films 28.

A metal-back 29 known, per se, in the art of CRT is provided on the face at the rear plate side of the fluorescent film 28. The metal-back 29 is provided in order to improve luminous efficiency by allowing it to serve as a mirror for reflecting a part of the light projected out of the fluorescent film 28, to protect the fluorescent film 28 from collision of negative ions, to utilize it as an electrode for impressing an electron beam accelerating voltage, and to allow it to serve as an electric current guide for electrons after exciting the fluorescent film 28.

The metal-back 29 was formed by subjecting the fluorescent film 28 to smoothing treatment followed by vacuum deposition of Al thereon after forming the fluorescent film 28 on the face plate substrate 27. However, the metal-back 29 is not needed when a fluorescent film for low acceleration voltage is used for the fluorescent film 28.

A transparent conductive film, for example ITO film, may be provided between the face plate substrate 27 and fluorescent film 28, although it was not used in this example.

The pins represented by the symbols Dox1 to Doxm, Doy1 to Doyn and Hv correspond to terminals provided for putting the airtight vessel as the display panel of this invention into electric continuity with electrical circuits (not shown in the drawing).

The pins Dox1 to Doxm, Doy1 to Doyn and Hv are electrically connected to the wiring along the row direction 23 of the multi-electron beam source, the wiring along the column direction of the multi-electron beam source and the metal back 29 of the face plate, respectively.

The construction of the airtight vessel constituting the image-forming apparatus manufactured in this example has been described in the foregoing explanation.

Now, the method for manufacturing the airtight vessel for use in the image-forming apparatus according to this example will be described hereinafter referring to FIGS. 1 and 2.

(Manufacturing of the Rear Plate)

(R-1) After cleaning the soda lime glass, the lower wiring 23 were formed by screen printing on the rear plate by a sputtering method of a silicon oxide film. Then, an interlayer insulation film is formed between the lower wiring 23 and upper wiring 24. After forming the upper wiring 24, electrodes 32 and 33 being electrically connected to the bottom wiring 23 and top wiring 24 were formed.

(R-2) In the next step, a conductive thin film 34 comprising PdO was formed by sputtering followed by patterning into a desired shape.

(R-3) A frit glass for fixing the supporting frame 26 was formed at a given position by printing.

A rear plate, on which the surface conduction type electron emission elements interconnected into a matrix prior to applying a forming step and adhesives for the supporting plate are formed was manufactured by the steps described above.

(Manufacturing of Face Plate)

(F-1) Fluorescent films 28 and black conductive members were printed on the soda lime glass substrate. After subjecting the inner side surface of the fluorescent film to smoothing treatment, Al was deposited by a vacuum deposition method to form the metal back.

(F-2) The frit glass for fixing the supporting frame 26 was printed at a given position.

The fluorescent film on which strips of three primary color fluorescent substances are alternately formed and adhesives for the supporting frame were formed on the face plate by the steps as described above.

(Manufacturing of the Vessel by Sealing with the Rear Plate and Face Plate)

(FR-1) The rear plate is held on a X-, Y- and θ-adjustment stage and the rear plate and face plate are heated at a sealing temperature while adjusting the positioning of the face plate. Although the seal temperature depends on the nature of the frit glass, a temperature of 410° C. was used for sealing in this example.

After the temperature had arrived at the sealing temperature, the supporting frame was made to contact with the rear plate and face plate while adjusting their positions with the X-, Y- and θ-adjustment stage. After holding the plates and the supporting frame under a pressure for 10 minutes, the temperature was decreased at a rate of 3° C. per minute. When the temperature was reduced by 100° C. lower than the sealing temperature, positioning was stopped and the temperature was decreased to room temperature while unlocking the stage.

(Manufacturing of Electron Emission Element)

(S-1) An evacuation tube 12 attached on the face plate 27 of the vessel manufactured as described above is connected to a vacuum pump to evacuate the vessel. The other evacuation tube 11 is equipped with a total pressure gauge (not shown in the drawing).

(S-2) When the pressure in the vessel had been decreased to 0.1 Pa or below, a voltage was impressed on each element electrode through the terminals Dox1 to Doxm and Doy1 to Doym projected out of the vessel to subject the conductive thin film 34 to the forming step.

(S-3) When the pressure in the vessel had been decreased to $1\times10^{-3}$ Pa or below, acetone as an activation gas was injected into the vessel at a pressure of 1 Pa through the evacuation tube 12 to subject the elements to activation treatment by impressing a voltage on each element electrode through the terminals Dox1 to Doxm and Doy1 to Doym projected out of the vessel.

(Degassing Step of the Inside of the Vessel and Airtight Sealing Step)

The succeeding degassing step of the inside of the vessel will be described by means of FIG. 1.

(D-1) After sufficiently evacuating the foregoing activation gas, the inside of the vessel is degassed by baking. The baking temperature was 300° C. and the heating rate was 2° C. per minute.

(D-2) When the temperature of the vessel has reached 300° C., an electric current is flowed through the electric current input-output terminals 2 and 3 of the nonevaporable getter while maintaining the temperature of the vessel at 300° C. to activate the nonevaporable getter. While the activation temperature depends on the kind of the nonevaporable getter, a heating treatment was applied by flowing an electric current at 600° C. for 15 minutes.

(D-3) After maintaining the temperature of the vessel at 300° C. for 10 hours, parts of the evacuation tubes 11 and 12 were sealed by heat-fusion while holding the vessel to be heated at 300° C., forming an airtight vessel by shutting down the inside of the vessel from outside.

(D-4) After completing the sealing step, the airtight vessel is cooled to room temperature at a cooling rate of 2° C. per minute.

Figure 5:
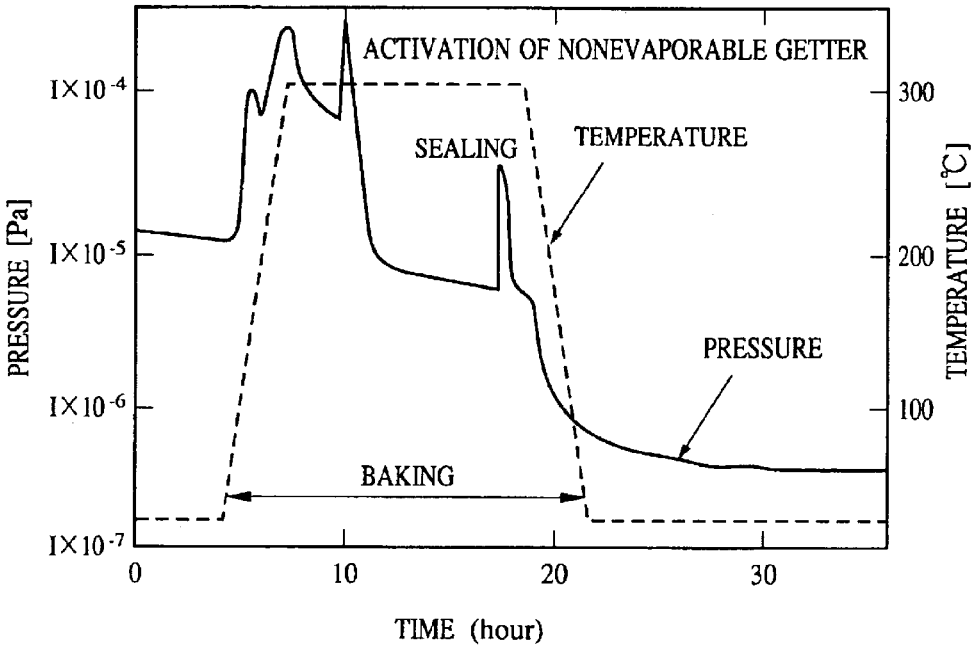
FIG. 5 is a graph showing the relation between the temperature profile of the vessel and press in the vessel in the process before and after the baking treatment in the examples.
Figure 7:
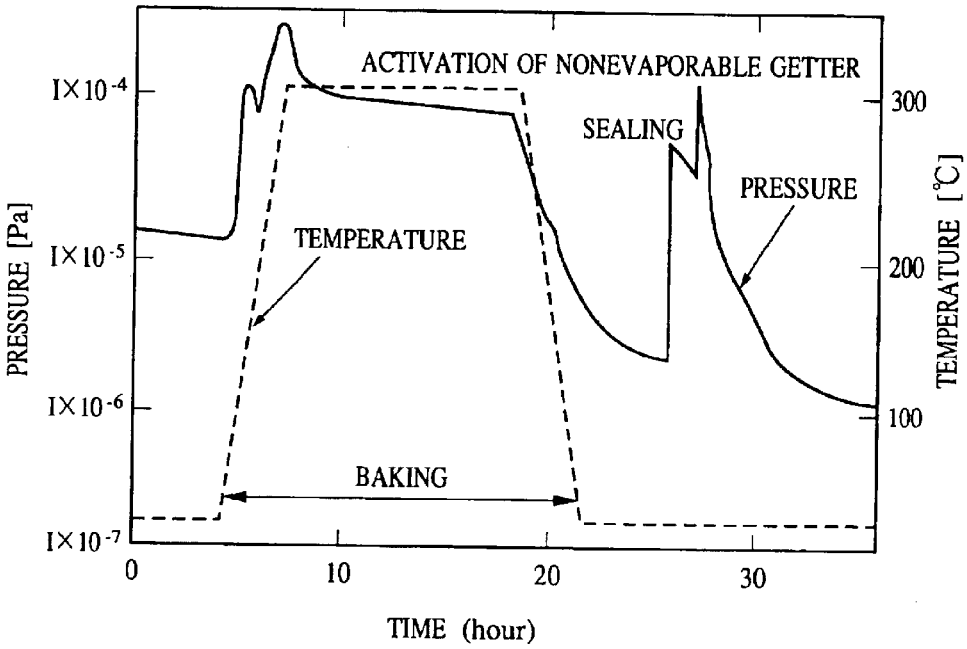
FIG. 7 is a graph showing the relation between the temperature profile of the vessel and pressure in the vessel before and after the baking treatment in Comparative Example 1.

The pressure in the vessel manufactured as described above was determined at each step after the degassing step. The results are shown in FIG. 5. The results of pressure measurements obtained when the degassing step was carried out by the following steps are shown in FIG. 7.

Comparative Example 1

(Degassing Step in the Vessel)

The degassing step in the vessel will be described hereinafter referring to FIG. 6. The other processes used in this comparative example are the same as used in Example 1.

(D-1) The vessel is degassed baking. The baking temperature was 300° C. and the heating rate was 2° C. per minute.

(D-2) After holding the temperature of the vessel at 300° C. for 10 hours, a part of the evacuation tube 11 was fused with heating to seal the pipe, thereby obtaining an airtight vessel.

(D-3) After sealing, the airtight vessel is cooled with a cooling rate of 2° C. per minute to room temperature.

(D-4) After cooling the airtight vessel to room temperature, an electric current was flowed through the electric current input-output terminals 2 and 3 of the nonevaporable getter to degassing and activate the nonevaporable getter. While the activation temperature of the nonevaporable getter depends on the kind of the getter, it was heat-treated at 600° C. by flowing an electric current for 15 minutes.

FIG. 5 and FIG. 7 shows that the airtight vessel prepared in Example 1 keeps a lower pressure than the airtight vessel prepared in Comparative Example 1 when the pressure is stabilized after sealing. The partial pressure in the airtight vessel was measured with a quadrupole mass spectrometer instead of measuring the total pressure in the vessel. The results of oxygen and water partial pressure changes during 24 hours after sealing are shown in TABLE 1.

TABLE 1

| | Partial pressure of water | Partial pressure of oxygen |
|---|---|---|
| Example 1 | $6 \times 10^{-10}$ Pa | $5 \times 10^{-11}$ Pa |
| Comparative Example 1 | $2 \times 10^{-9}$ Pa | $1 \times 10^{-10}$ Pa |

It can be confirmed from TABLE 1 that the manufacturing method according to Example 1 gives partial pressures that are by one digit lower than those in the Comparative Example 1 against water and oxygen that are the deteriorating gases for the electron emission characteristics of the cold cathode.

EXAMPLE 2

This example also gives an image-forming apparatus using the surface conduction type electron emission element (refer to FIGS. 2, 3 and 4 with respect to the image-forming apparatus).

Figure 8:
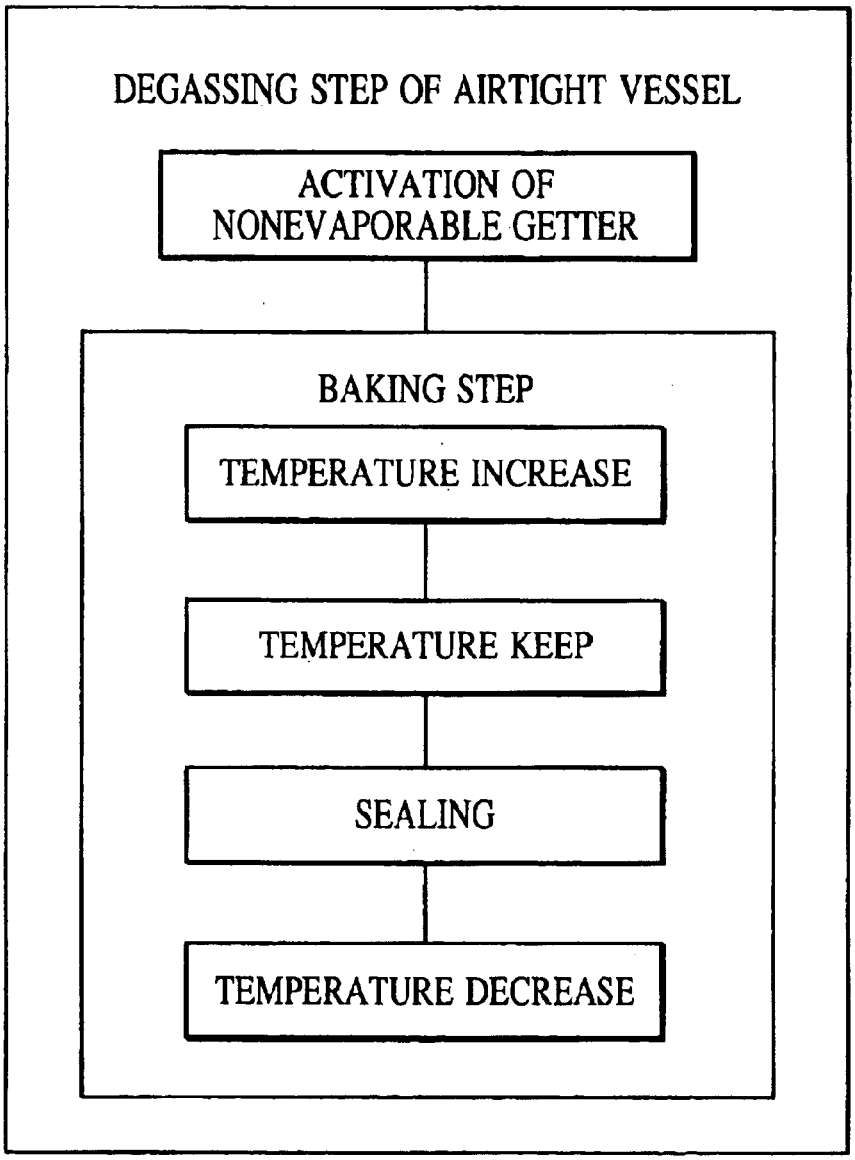
FIG. 8 shows the flow chart in the degassing step in Example 2.

The method for manufacturing the image-forming apparatus according to this example will be described referring to FIG. 8.

(Manufacturing of Rear Plate)

(R-1) After cleaning the soda lime glass, the lower wiring 23 was formed by screen-printing on the rear plate 25 on which a silicon oxide film was formed by sputtering. Then, an interlayer insulation film is formed between the lower wiring 23 and upper wiring 24. After forming the upper wiring 24, the element electrodes 32 and 33 that are connected to the lower wiring 23 and upper wiring 24 were formed.

(R-2) After depositing the conductive thin film 34 comprising PdO by sputtering, the film was patterned to a given shape.

(R-3) The frit glass for fixing the supporting frame 26 was formed at a given position.

The rear plate, on which the surface conduction type electron emission elements interconnected into a matrix prior to applying a forming step and the adhesives for the supporting frame were formed, was manufactured by the steps described above.

(Manufacturing of Face Plate)

(F-1) Fluorescent films 28 and black conductive members were printed on the blue glass substrate. After subjecting the inner side surface of the fluorescent film to a smoothing treatment, Al was deposited by a vacuum deposition method to form the metal back.

(F-2) The frit glass for fixing the supporting frame 26 was printed at a given position.

The fluorescent film on which stripes of three primary color fluorescent films are alternately formed and adhesives for the supporting frame were formed on the face plate by the steps as described above.

(Manufacturing of Vessel by Adhering Rear Plate and Face Plate)

(FR-1) The rear plate 25 was held on a X-, Y- and θ-adjustment stage and the temperature of the rear plate and the face plate were raised at a sealing temperature while adjusting the position of the face plate 27. Although the seal temperature depends on the nature of the frit glass, a temperature of 410° C. was used for sealing in the present example.

After the temperature had arrived at the sealing temperature, the supporting frame was made to contact with the rear plate and face plate while adjusting their positions with the X-, Y- and θ-adjustment stage. After holding the plates and the supporting frame under a pressure for 10 minutes, the temperature was decreased at a rate of 3° C. per minute. When the temperature was reduced by 100° C. lower than the sealing temperature, positioning was stopped and the temperature was decreased to room temperature while unlocking the stage.

(Manufacturing of Electron Emission Element)

(S-1) Evacuation tubes 11 and 12 attached on the face plate of the vessel manufactured as described above are connected to a vacuum pump to evacuate the vessel.

(S-2) When the pressure in the vessel was decreased to 0.1 Pa or below, a voltage was impressed on each element electrode through the terminals Dox1 to Doxm and Doy1 to Doym projected out of the vessel to subject the conductive thin film 34 to the forming step.

(S-3) When the pressure in the vessel had been decreased to $1\times10^{-3}$ Pa or below, acetone as an activation gas was introduced into the vessel at a pressure of 1 Pa through the evacuation tube 11 to subject the elements to activation treatment by impressing a voltage on each electron emission element through the terminals Dox1 to Doxm and Doy1 to Doym projected out of the vessel.

(Degassing Step of Inside of Vessel and Airtight Sealing Step)

The process for the degassing step of the inside of the vessel will be described referring to FIG. 8.

(D-1) After thoroughly evacuating the activation gases for the element, an electric current is allowed to flow through the electric current input-output terminals 2 and 3 to subject the nonevaporable getter to the degassing treatment and to activate the getter. Although the activation temperature of the nonevaporable getter depends on its nature, it was heated at 600° C. by flowing the electric current for 15 minutes.

(D-2) The vessel is then baked and degassed. The baking temperature was 300° C. with a temperature increase rate of 2° C. per minute.

(D-3) After holding the vessel at a temperature of 300° C. for 10 hours, parts of the evacuation tubes 11 and 12 were sealed by heat-fusion while maintaining the foregoing temperature, thereby manufacturing an airtight vessel.

(D-4) The airtight vessel is cooled to room temperature at a cooling rate of 2° C. per minute after completing the sealing step.

Figure 9:
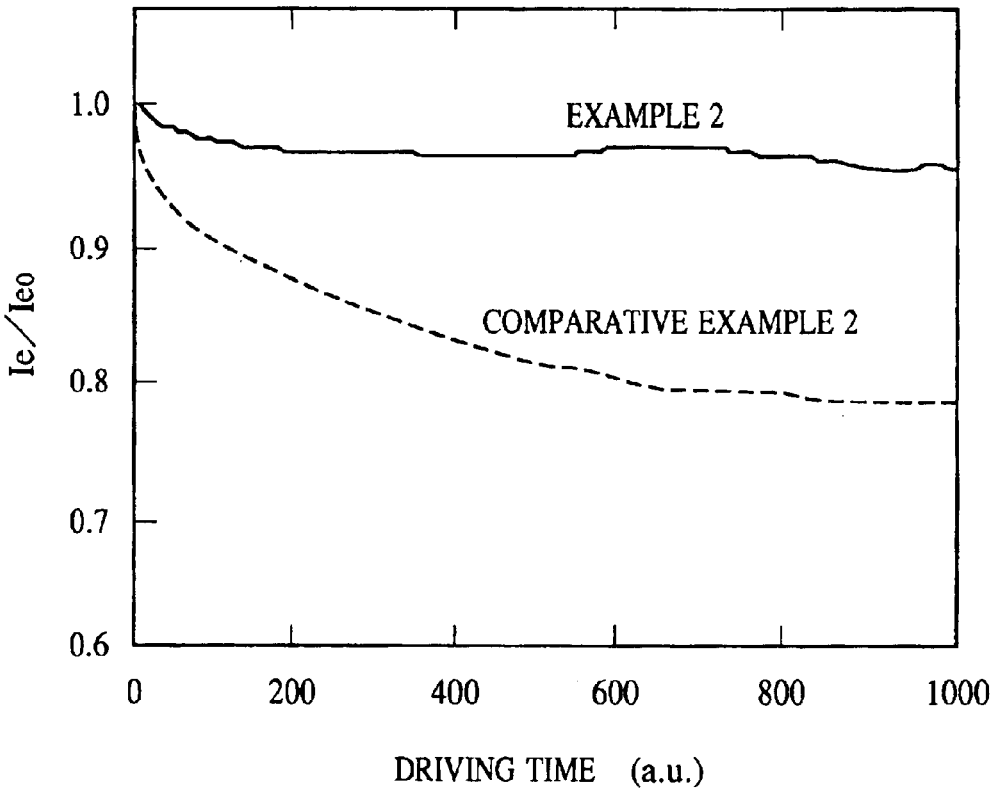
FIG. 9 is a graph showing the time-dependent changes of electron emission characteristics in Example 2 and in Comparative Example 2.

The time-dependent changes of the electron emission characteristics of the airtight vessel manufactured as described above were measured. The results are shown in FIG. 9. A pulse waveform with a voltage of 15 V was impressed among the electron emission elements while a high voltage of Va=5 kV was impressed on the face plate. The electric current flowing through the face plate is expressed as Ie. However, the electric current used for plotting in the graph is normalized with the current immediately after impressing the voltage.

Comparative Example 2

(Degassing Step of Vessel)

Figure 6:
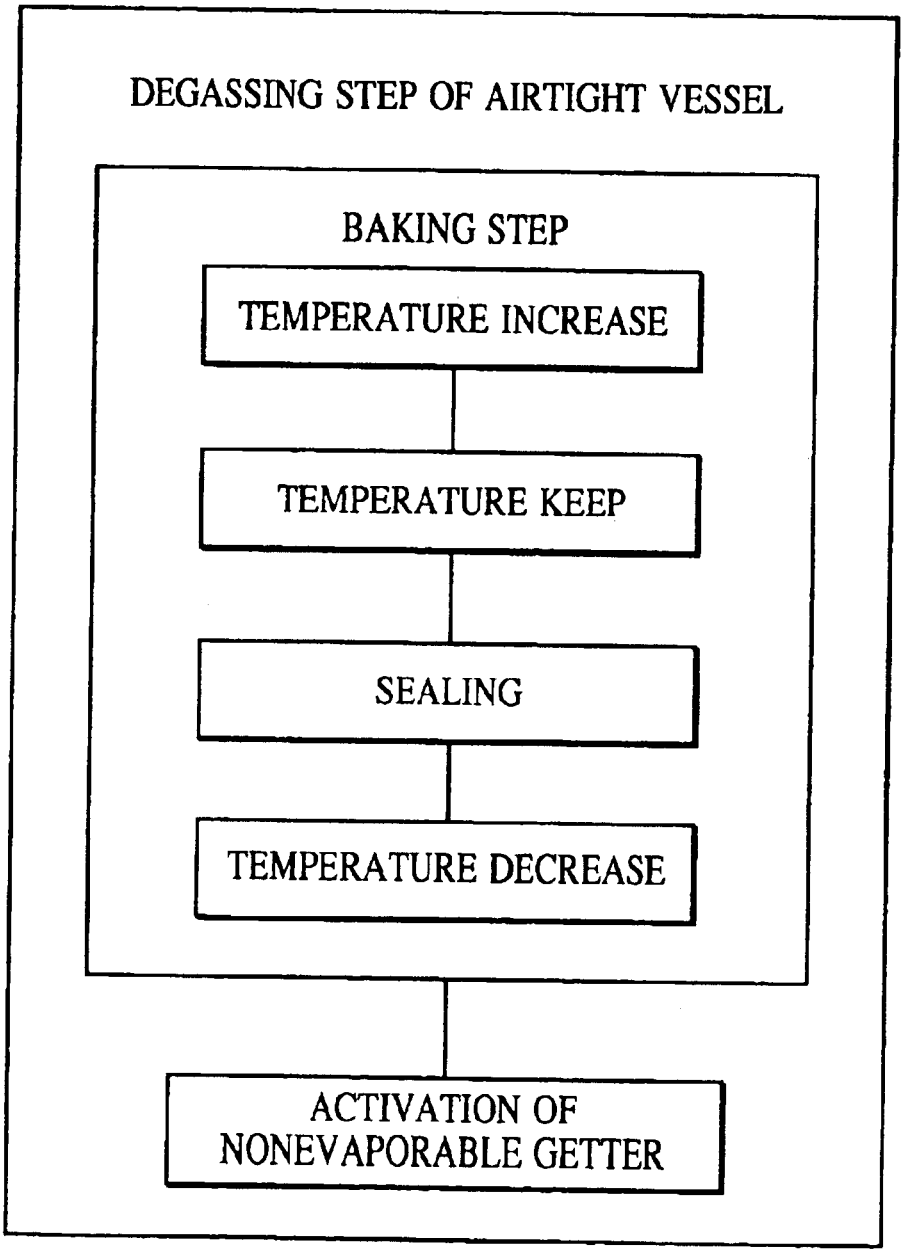
FIG. 6 shows a flow chart in the process in Comparative Example 1.

Degassing step inside of the vessel will be described referring to the process flow sheet (FIG. 6).

(D-1) The vessel is baked and degassed. The baking temperature was adjusted to 300° C. with a temperature increase rate of 2° C. per minute.

(D-2) After holding the temperature of the vessel at 300° C. for 10 hours, parts of the evacuation tubes 11 and 12 were heat-fused for sealing.

(D-3) When the sealing step has been completed, the airtight vessel is cooled to room temperature by decreasing the temperature at a rate of 2° C. per minute.

(D-4) After cooling the airtight vessel to room temperature, an electric current is allowed to flow through the electric current input-output terminals 2 and 3 of the nonevaporable getter to subject it to the degassing and activation treatments. Although the activation temperature of the nonevaporable getter depends on its nature, it was heat-treated at 600° C. by flowing an electric current for 15 minutes.

The time-dependent changes of the electron emission characteristics in the airtight vessel manufactured as described above were measured. The results are shown in FIG. 9.

FIG. 9 shows that Ie that determines luminance of the fluorescent film, or the electron emission characteristic of the electron source in the image-forming apparatus using the airtight vessel manufactured in this example is more stable with very small deterioration than that in Comparative Example 2.

EXAMPLE 3

Figure 10:
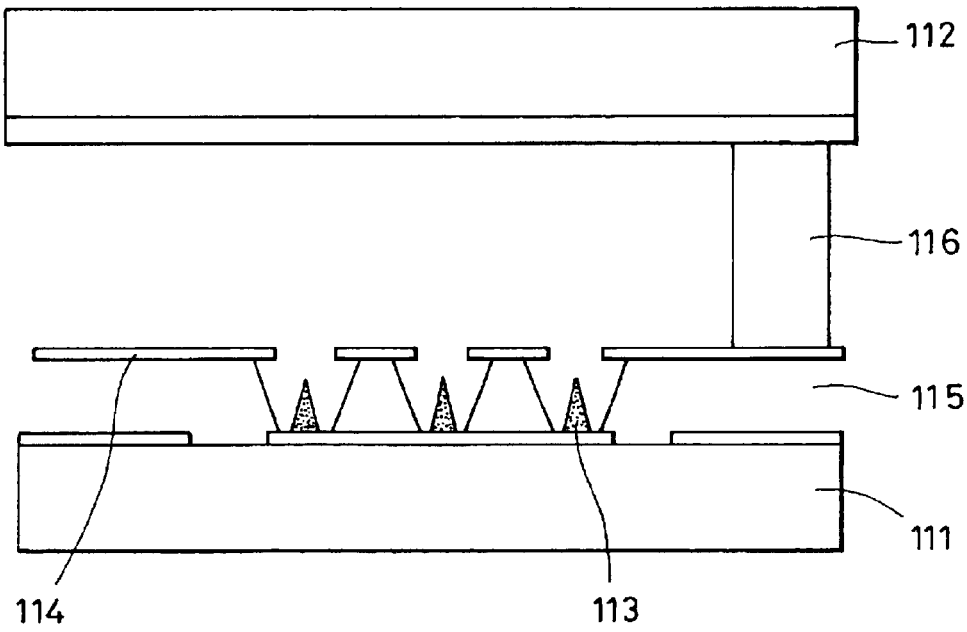
FIG. 10 is an illustrative drawing showing the field effect type electron emission element.

An image-forming apparatus using the airtight vessel with the construction as shown in FIG. 10 was manufactured in this example.

A plurality of field emission elements were formed on the rear plate 111 and providing a spacer 116 between face plate 112 and rear plate 111 as a supporting member to be used under atmospheric pressure in order to make the image-forming apparatus lightweight. The face plate 112 is provided with fluorescent films and a color image-forming apparatus with a vertical to transverse length ratio of 3:4 whose effective display area has a diagonal length of 10 inches was manufactured.

Figure 11:
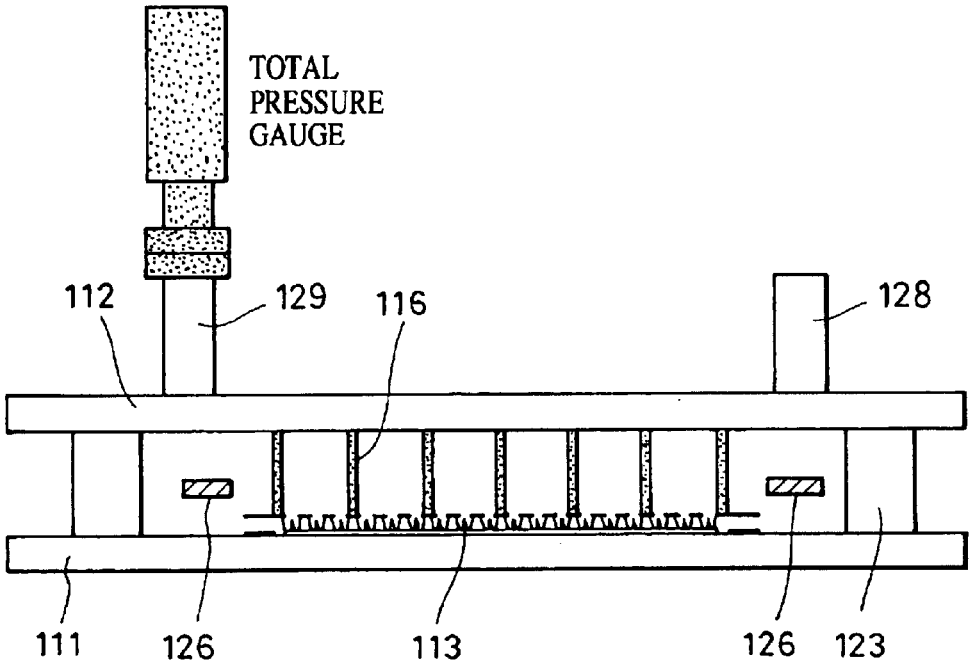
FIG. 11 is a perspective view showing an outline of the image-forming apparatus making use of the field effect type electron emission element formed in Example 3.

The construction of the airtight vessel constituting the image-forming apparatus according to this example, then the method for manufacturing the same, will be described referring to FIG. 11. In FIG. 10, the reference numeral 111 denotes a rear plate, the reference numeral 112 denotes a face plate, the reference numeral 113 denotes a cathode, the reference numeral 114 denotes a gate electrode, and the reference numeral 115 denotes an insulation layer between the gate and cathode. The reference numeral 112 denotes a face plate, the reference numeral 123 denotes a supporting frame, the reference numeral 111 denotes a rear plate and the reference numeral 116 denotes a spacer in FIG. 11. The gap between the face plate 121 and the rear plate 125 is 1.5 mm. The reference numeral 126 denotes a nonevaporable getter.

Figure 12:
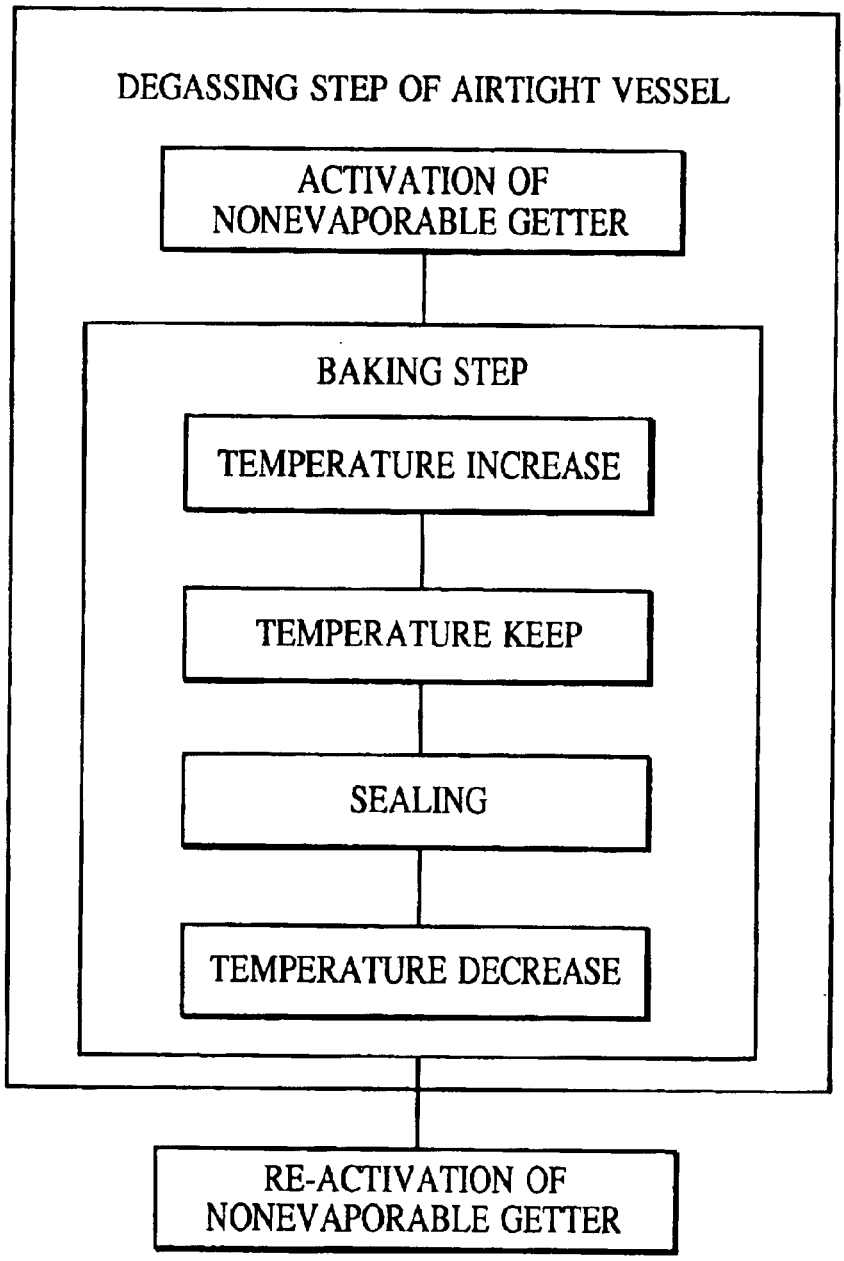
FIG. 12 shows the flow chart of the degassing process in Example 3.

The method for manufacturing the airtight vessel according to this example will be then described referring to FIG. 12.

(Manufacturing of Rear Plate)

(R-1) After cleaning the soda lime glass, the cathode (an emitter), gate electrode and wiring shown in FIG. 10 were formed by the method known in the art. Mo was used as a material for the cathode 113.

(R-2) The frit glass for fixing the supporting frame was printed at a desired position.

The rear plate, on which the field emission type electron emission elements interconnected into a matrix for and the adhesives for the supporting frame were formed was manufactured by the steps described above.

(Manufacturing of Face Plate)

(F-1) Fluorescent films and black conductive members were printed on the soda lime glass. The surface of the inner side of the fluorescent film was subjected to smoothing treatment followed by forming a metal back by depositing Al by vacuum deposition.

(F-2) The frit glass for fixing the supporting frame was printed at a desired position.

The fluorescent film on which stripes of three primary color fluorescent films are alternately formed and adhesives for the supporting frame were formed on the face plate by the steps as described above.

(Manufacturing of Vessel by Sealing Rear Plate and Face Plate)

(FR-1) The rear plate was held on a hot plate on the X-, Y- and θ-adjustment stage and the temperature of the rear plate and the face plate were raised at a sealing temperature while adjusting the position of the face plate. Although the seal temperature depends on the nature of the frit glass, a temperature of 460° C. was used for sealing in the present example.

After the temperature had arrived at the sealing temperature, the supporting frame was made to contact with the rear plate and face plate while adjusting their positions with the X-, Y- and θ-adjustment stage. After holding the plates and the supporting frame under a pressure for 10 minutes, the temperature was decreased at a rate of 3° C. per minute. When the temperature was reduced by 100° C. lower than the sealing temperature, positioning was stopped and the temperature was decreased to room temperature while unlocking the stage.

(Evacuation Step)

(S-1) A total pressure gauge was attached to the evacuation tube 129 on the face plate of the vessel manufactured as described previously along with connecting the evacuation tube 128 to the vacuum pump to evacuate the inside of the vessel.

(Degassing Step of Inside of Vessel and Airtight Sealing Step)

The process for evacuating the inside of the vessel is described referring to the flow diagram (FIG. 12).

(D-1) When the pressure in the vessel has decreased to $1\times10^{-4}$ Pa or less, an electric current is flowed through the nonevaporable getter for degassing and activating the nonevaporable getter. Although the activation temperature of the nonevaporable getter depends on its nature, it was heated at 750° C. by flowing an electric current for 5 minutes.

(D-2) The vessel was then baked and degassed. The baking temperature was 350° C. with a heating rate of 2° C. per minute.

(D-3) After holding the vessel at 350° C. for 10 hours, a part of the evacuation tube was sealed by heat-fusion while maintaining the foregoing temperature, thereby manufacturing an airtight vessel.

(D-4) When the tube has been sealed, the temperature of the airtight vessel is cooled to room temperature with a cooling rate of 2° C. per minute.

(D-5) When the panel had been cooled to room temperature, the nonevaporable getter was re-activated by flowing an electric current through the getter by heating at 600° C. for 15 minutes.

Figure 13:
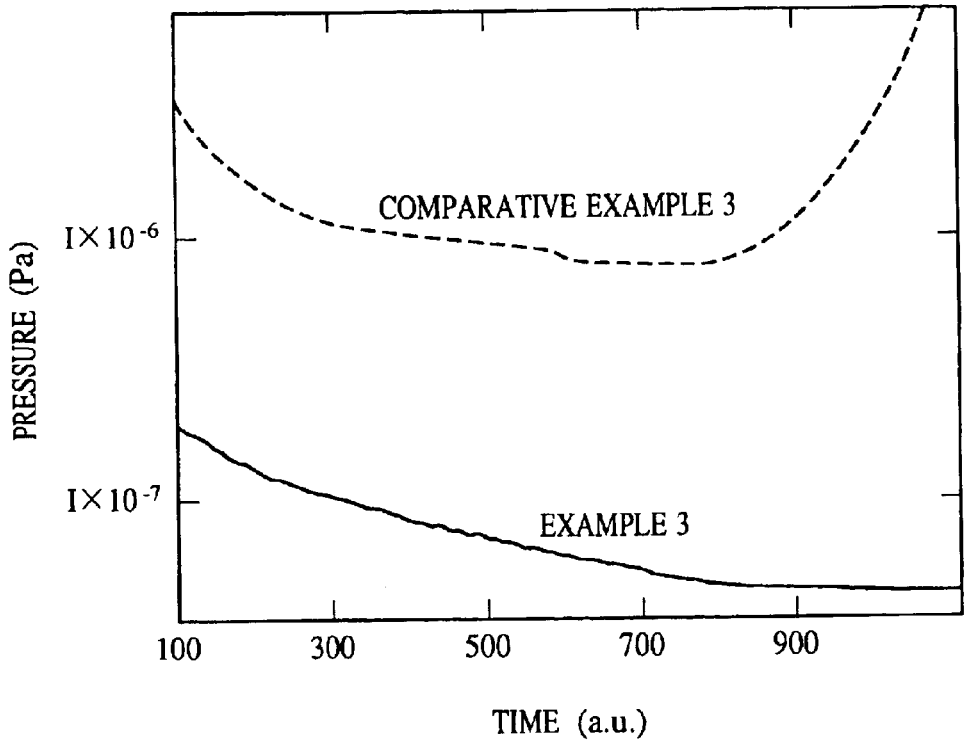
FIG. 13 is a graph showing the time-dependent changes of the pressure in the vessel manufactured in Example 3 and Comparative Example 3.

The pressure in the airtight vessel manufactured as described above was measured at each step after the sealing step. The results are shown in FIG. 13. The results of pressure measurements of the airtight vessel prepared by the degassing step as will be described below are also shown in FIG. 13 as a comparative example.

Comparative Example 3

(Degassing Step of Inside of Vessel and Airtight Sealing Step)

The process for evacuating the inside of the vessel is described referring to the flow diagram (FIG. 6). An airtight vessel was manufactured by the same method as described in Example 3, except that the above degassing step (FIG. 6) was used.

(D-1) The vessel is baked for degassing at a temperature of 350° C. with a heating rate of 2° C. per minute.

(D-2) After holding the vessel at 350° C. for 10 hours, a part of the evacuation tube 128 was sealed by heat-fusion while maintaining the foregoing temperature, thereby manufacturing an airtight vessel.

(D-3) When the tube has been sealed, the temperature of the airtight vessel is cooled to room temperature with a cooling rate of 2° C. per minute.

(D-4) When the panel had been cooled to room temperature, the nonevaporable getter 126 was activated by flowing an electric current through the getter at a temperature of 750° C. by flowing the electric current for 5 minutes.

FIG. 13 shows that the airtight vessel according to this example can attain a high vacuum from the initial stage of evacuation, maintaining a stable high vacuum for a long period of time. In the comparative example, on the contrary, the pressure remains high from the initial stage of evacuation, showing an abrupt pressure increase at a give time and thereafter. Because the nonevaporable getter was activated after sealing, the gas discharge rate in the airtight vessel becomes larger in the comparative example than in the example, wasting the life span of the nonevaporable getter to result in remarkable deterioration of adsorption ability.

EXAMPLE 4

Figure 14:
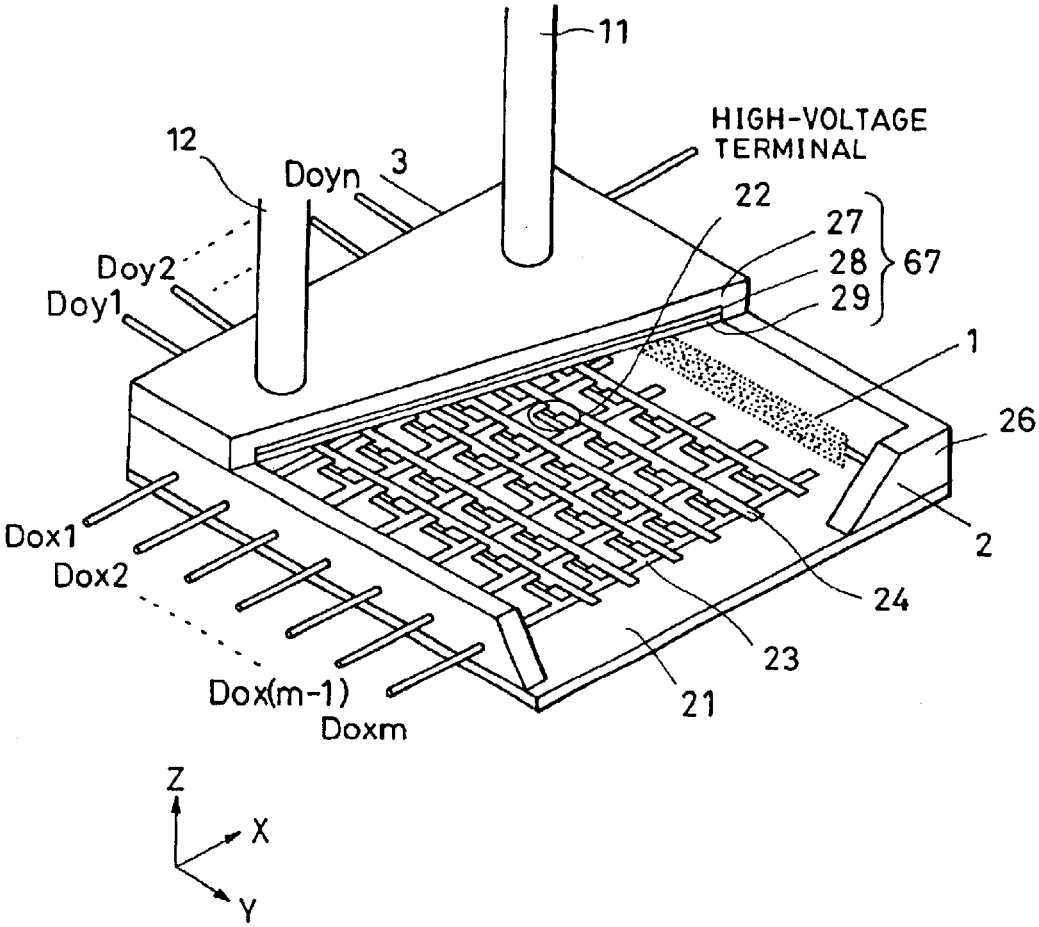
FIG. 14 is a perspective view showing an outline of the image-forming apparatus manufactured in Example 4.

An image-forming apparatus using the surface conduction type electron emission device was manufactured in this example (FIG. 14). For simplifying the description, a vessel before sealing the evacuation tubes 11 and 12 is shown in FIG. 14. The largest difference between this example and Example 1 is that a forming step and an activation step were applied before manufacturing of vessel by sealing rear plate and face plate. The electron source substrate also serves as a rear plate in this example.

The method for manufacturing the image-forming apparatus according to this example will be described hereinafter referring to FIG. 14, FIG. 3 and FIG. 15. For simplifying the description, a process for manufacturing nine surface conduction type electron emission elements is shown in FIG. 15. Actually, 400 and 1,500 pieces of the electron emission elements along the row direction and column direction, respectively, are arranged on the substrate 21 forming a matrix.

Step A: A silicon oxide film was deposited on the entire surface of the substrate 21 comprising a cleaned soda lime glass plate by a sputtering method.

Figure 15A:
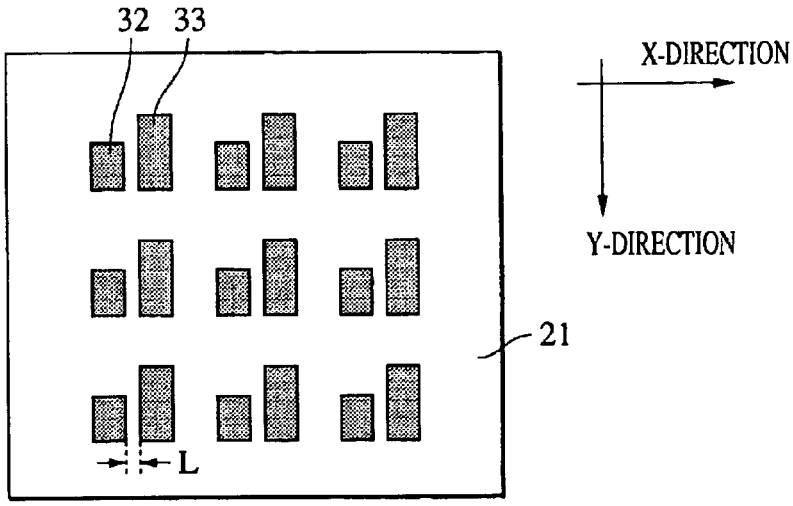
FIGS. 15A, 15B, 15C, 15D, 15E and 15F are illustrative diagrams showing the process for forming the electron source plate manufactured in Example 4.

Step B: A Ti film with a thickness of 5 nm and a Pt film with a thickness of 50 nm were successively deposited by sputtering in this order. Then, patterns of the electrodes 32 and 33 were formed using a photoresist, and the Pt/Ti deposition layer outside of the patterns of the electrodes 32 and 33 were removed by dry-etching. The photoresist pattern was finally removed to form the electrodes 32 and 33 (FIG. 15A). The distance between the electrodes was 20 $\mu$m in this example.

Figure 15B:
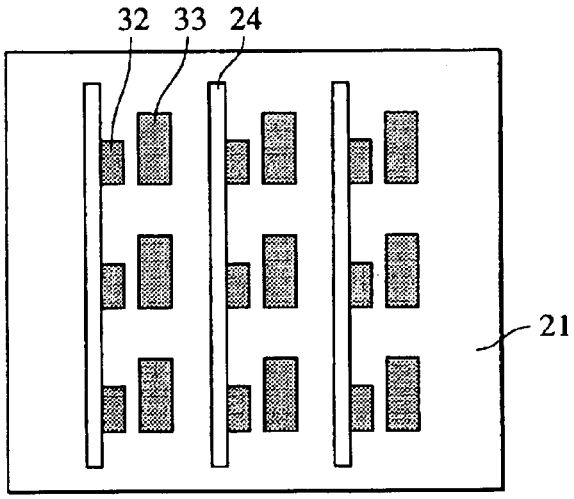

Step C: A plurality of wiring along the column direction (Y-direction) 24 to be connected to each electrode 32 was formed by screen-printing (FIG. 15B).

Figure 15C:
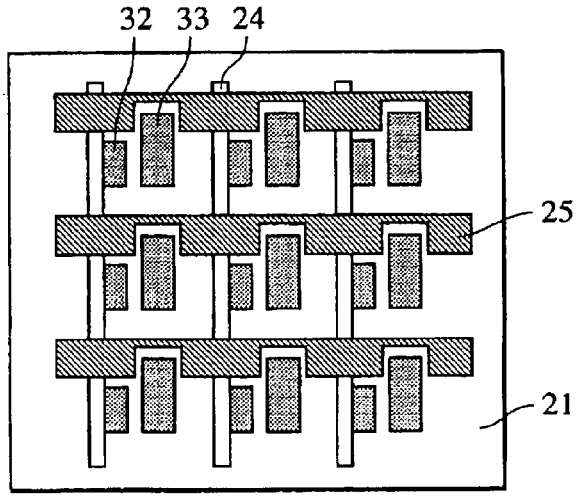

Step D: Then a plurality of interlayer insulation layers 25 for electrically insulating the wiring 23 along the row direction from the wiring 24 along the column direction were formed by screen-printing (FIG. 15C).

Figure 15D:
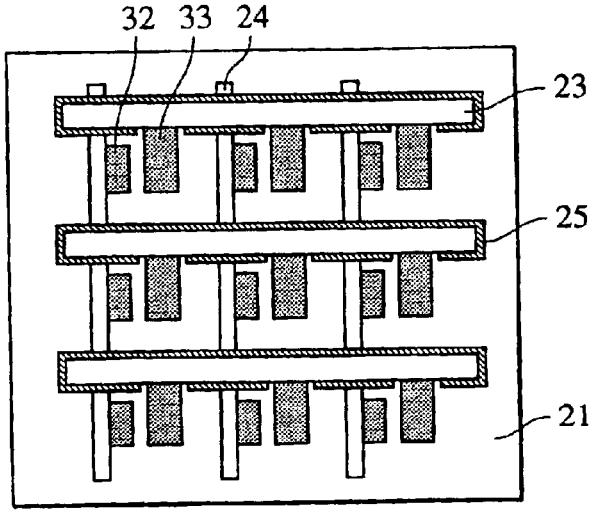

Step E: A plurality of wiring 23 along the row direction (X-direction) to be connected to each element electrode 33 were formed on the interlayer insulation layers 25 by screen-printing (FIG. 15D). While the wiring 23 along the row direction, the wiring 24 along the column direction and the interlayer insulation layers 25 were formed by screen-printing in this example, other manufacturing methods may be also used.

Figure 15E:
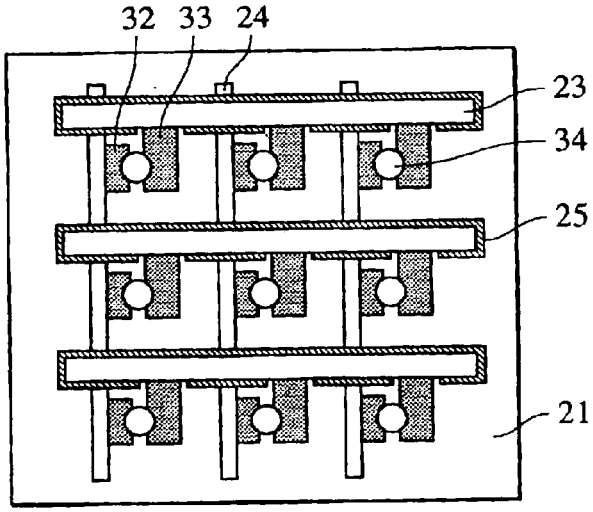

Step F: Conductive films 34 comprising palladium oxide were formed so as to connect the gaps between the electrodes 32 and 33 (FIG. 15E). A PdO film with a film thickness of 10 nm was formed by baking in this example after providing a solution of an organic palladium between the electrodes 32 and 33 by an ink-jet method.

An electron source substrate prior to subjecting to the forming step was manufactured by the steps described above, wherein the lower wiring 24, interlayer insulation layers 25, upper wiring 23, electrodes 32 and 33, and conductive films 34 are formed on the substrate 1.

Step G (energization forming step): The electron source substrate 21 prior to subjecting to the forming step prepared as described above was transferred in a chamber (not shown in the drawing). Then, after evacuating the inside of the chamber to a pressure of $1\times10^{-4}$ Pa, an electric current was flowed through the electrodes 32 and 33 (energization forming treatment) through each wiring 23 and 24 along the row and column directions, respectively, thereby forming a gap on a portion of each conductive film 34.

The voltage waveform to be used in the foregoing forming step is preferably a pulse waveform. The pulse wave is generated by either a method in which pulses having a constant voltage at the highest level of the pulse wave are continuously impressed (FIG. 17A) or a method in which the pulse voltage is impressed while increasing the highest level of the pulse wave (FIG. 17B).

Figure 17A:
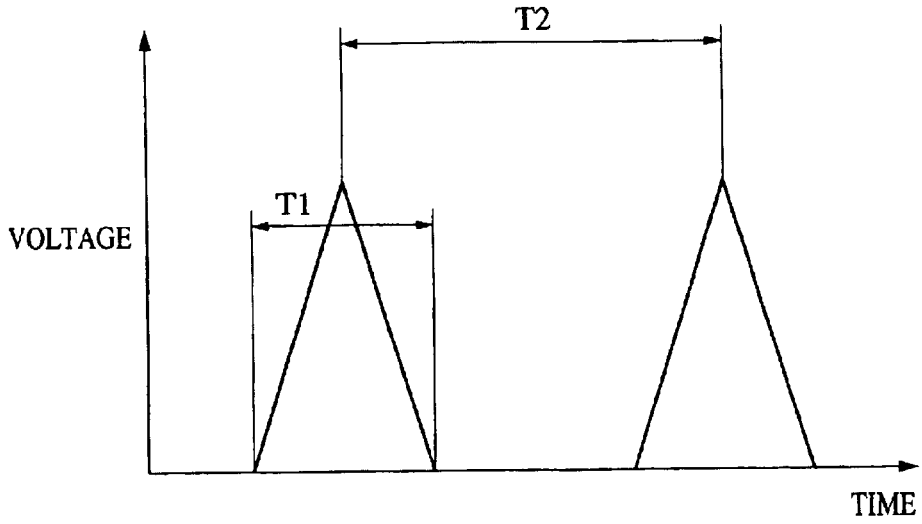
FIGS. 17A and 17B are pulse waveforms preferably used in the forming step of the surface conduction type electron emission element.
Figure 17B:
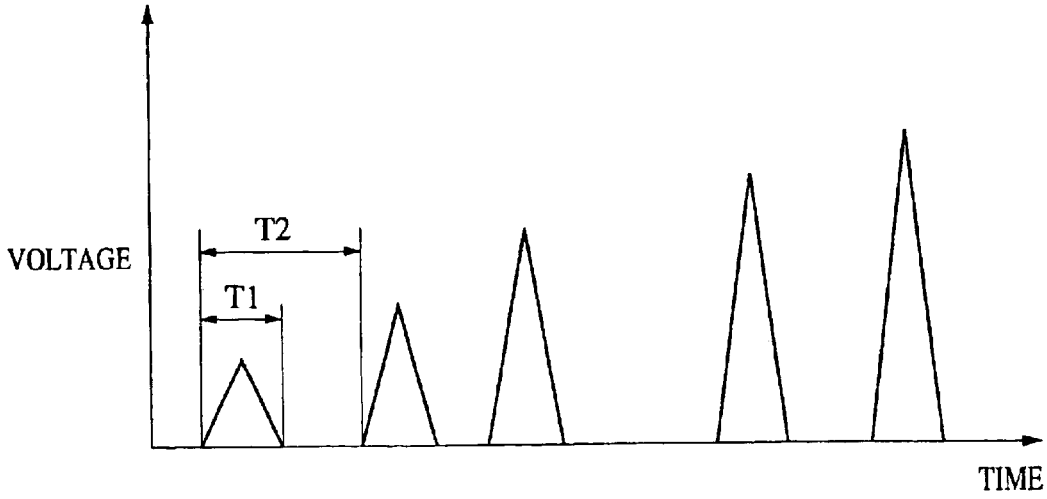

T1 and T2 in FIGS. 17A and 17B represent the pulse-to-pulse distance of the voltage waveform. T1 is usually 1 μsec to 10 msec while T2 is adjusted in a range of 10 μsec to several hundreds milliseconds. A voltage is impressed, for example, for several seconds to several tens of seconds under the conditions as described above. The pulse waveform is not limited to a triangular wave but desired waveforms such as a rectangular wave may be used.

The highest level of the triangular wave may be increased by a desired discrete rate of 0.1 V per one step.

The pulse with the waveform as shown in FIG. 17B was used in the forming step of this example. The pulse intervals of T1 and T2 were 1 msec and 10 msec, respectively, in this example.

The end point of the forming treatment by an electric current is determined by sensing the resistivity by measuring the electric current when a pulse voltage with a level not locally destroying or deforming the conductive film 34 is inserted among the pulse voltages for the foregoing forming step. For example, the forming step by flowing an electric current is completed when the resistance of 1 MΩ or more was observed from the measured electric current flowing through the electroconductive film 34 by applying a voltage of about 0.1 V.

The forming step was completed in this example at the stage when the wave level of the impressed pulse shown in FIG. 17 had reached to about 5 V since the resistance exceeded 1 MΩ.

Figure 16A:
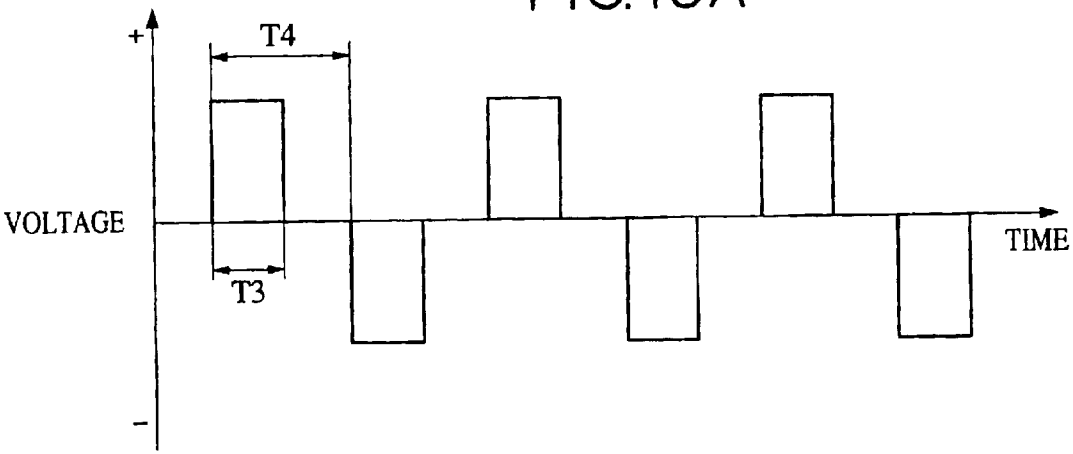
FIGS. 16A and 16B show a pulse waveform preferably used in the activation step of the surface conduction type electron emission element.
Figure 16B:
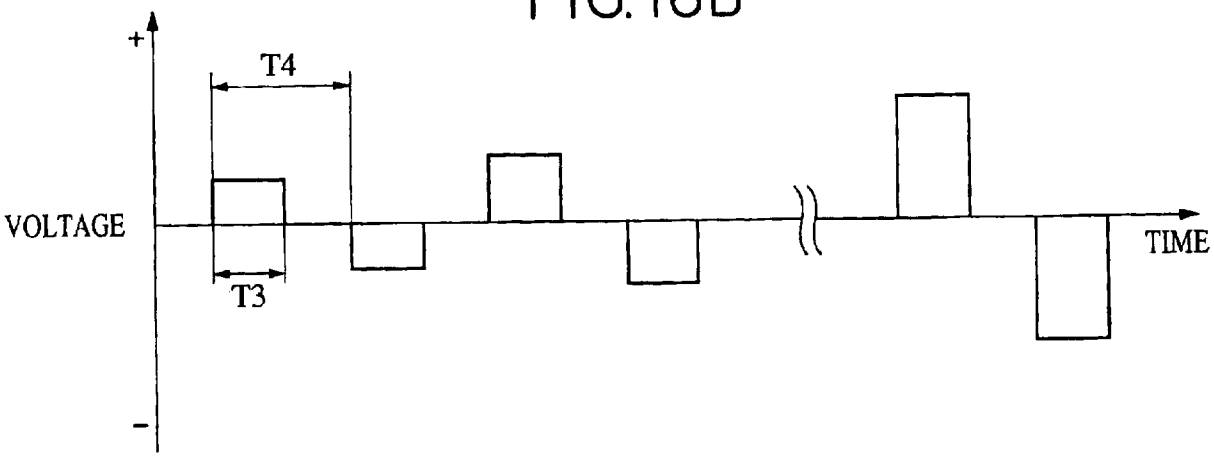

Step H (energization activation step): The inside of the chamber was evacuated to an order of $10^{-6}$ Pa, followed by injecting benzonitrile so that the total pressure in the chamber reaches to $1\times10^{-4}$ Pa. A pulse voltage with a wave level of 15 V was impressed on the electrodes 2 and 3 through each wiring 23 along the raw direction and each wiring 24 along the column direction. Although the pulses with the waveform as shown in FIG. 16A were impressed in the activation treatment of this example, the pulses with the waveform as shown in FIG. 16B may be impressed. T3 and T4 denote the pulse width and pulse interval, respectively, in FIG. 16. The pulse width T3 was 1 msec and the pulse interval was T4 10 msec in this example.

Carbon films were formed on the substrate among the gaps formed by the forming step and on the conductive films 34 on the periphery of the gaps by this activation treatment.

Figure 15F:
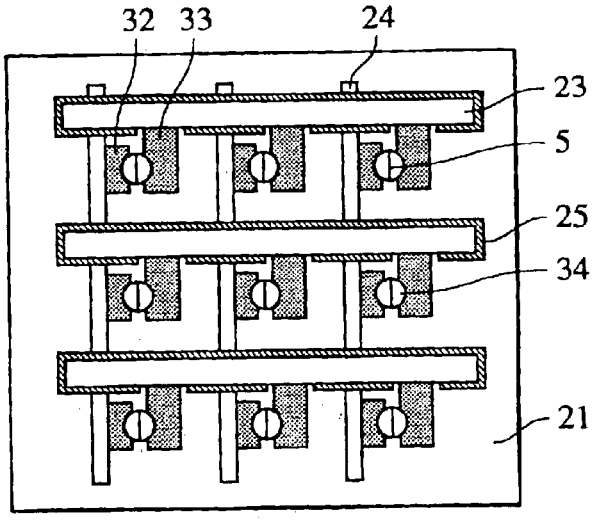

The electron emission portion 5 was formed by the steps as hitherto described (FIG. 15F).

Step I: A vessel was manufactured (FIG. 14) by sealing (joining) the face plate 67 (constructed by forming the fluorescent films 28 and metal back 29 on the inner face of the glass substrate 27) with the frit glass via the supporting frame 26 by the same method as shown in Example 1, wherein the evacuation tubes 11 and 12 are disposed by 5 mm upward of the electron source substrate 21.

Sealing was carried out at 400° C. in an Ar atmosphere in this example.

A Zr—V—Fe alloy mainly composed of Zr was used in this example as the non-volatile getter 1 disposed in the vessel.

Black stripes were formed at first and stripes of the fluorescent films 28 were formed by coating fluorescent substances of each color on the open spaces among the black stripes.

Fluorescent films with respective colors were exactly positioned on respective electron emission elements before sealing.

While two evacuation tubes were used in this example, the number of the evacuation tubes are not limited thereto but four evacuation tubes may be disposed at four corners of the face plate in order to accelerate evacuation speed.

Step J (Degassing Step of Vessel and Airtight Sealing Step):

In the next step, the vessel was degassed and sealed to form an airtight vessel according to the process shown in FIG. 1.

(D-1) The evacuation tubes 11 and 12 prepared in the foregoing step I were connected to the vacuum pump (not shown in the drawing) to sufficiently evacuate the inside of the vessel. Evacuation was continued while increasing the temperature of the entire vessel including the evacuation tubes 11 and 12 from room temperature at an increase rate of 2° C. per minute.

(D-2) Evacuation was still continued after the temperature of the entire vessel had reached to 300° C. by maintaining the temperature, when an electric current was flowed into the electric current input-output terminals 2 and 3 of the non-evaporable getter 1 to activate the nonevaporable getter. The getter was activated at 600° C. for 15 minutes.

The higher the baking temperature is, the more degassing from the members constituting the vessel is accelerated. Accordingly, the baking temperature is not limited to 300° C. but may be higher provided that the frit is not melted or the electron emission element is not damaged by heating.

(D-3) After baking and evacuating the vessel at 300° C. for 10 hours, parts of the evacuation tubes 11 and 12 were fused while keeping evacuation and heating to seal (chip-off) the tubes. The vessel connected to the vacuum pump via the evacuation tubes 11 and 12 was isolated from the vacuum pump by this step, manufacturing an airtight vessel inside of which is spatially shut down from outside of the vessel.

(D-4) After completing the sealing step, the airtight vessel was cooled to room temperature at a cooling rate of 2° C. per minute.

Using the airtight vessel according to this example the evacuation tubes 11 and 12 of which had been sealed, scanning signals generated by signal generation means (not shown in the drawing) were impressed on Dox1 to Doxm projected out of the vessel, and modulation signals were impressed on Doy1 to Doym projected out of the vessel to allow electrons to emit from each electron emission element. A high voltage of 5 kV was simultaneously impressed on the metal back 29 through the high voltage terminal Hv to allow emitted electron beams to collide with the fluorescent film 28 after acceleration, thereby forming images by excitation and light emission of the fluorescent film.

The sealing step is executed in this example after the energization activation step requiring organic gases has been completed. Accordingly, adsorption and contamination of organic substances on the inner walls of the vessel and evacuation tubes ascribed to injection of organic substances into the vessel as seen in Example 1 can be avoided, making degassing easy.

The image-forming apparatus according to this example manufactured by the steps as hitherto described can form stable and high quality images having sufficient luminance for use in television for a long period of time.

EXAMPLE 5

An image-forming apparatus was manufactured in this example by disposing a Ba getter as an evaporable getter in addition to the nonevaporable getter 1.

The manufacturing process according to this example includes the same steps A to I as in Example 4.

However, a ring getter comprising Ba was placed in the airtight vessel in this example.

Although the ring-shaped evaporable getter was used in this example, a wire-shaped evaporable getter may be used as well.

Figure 18:
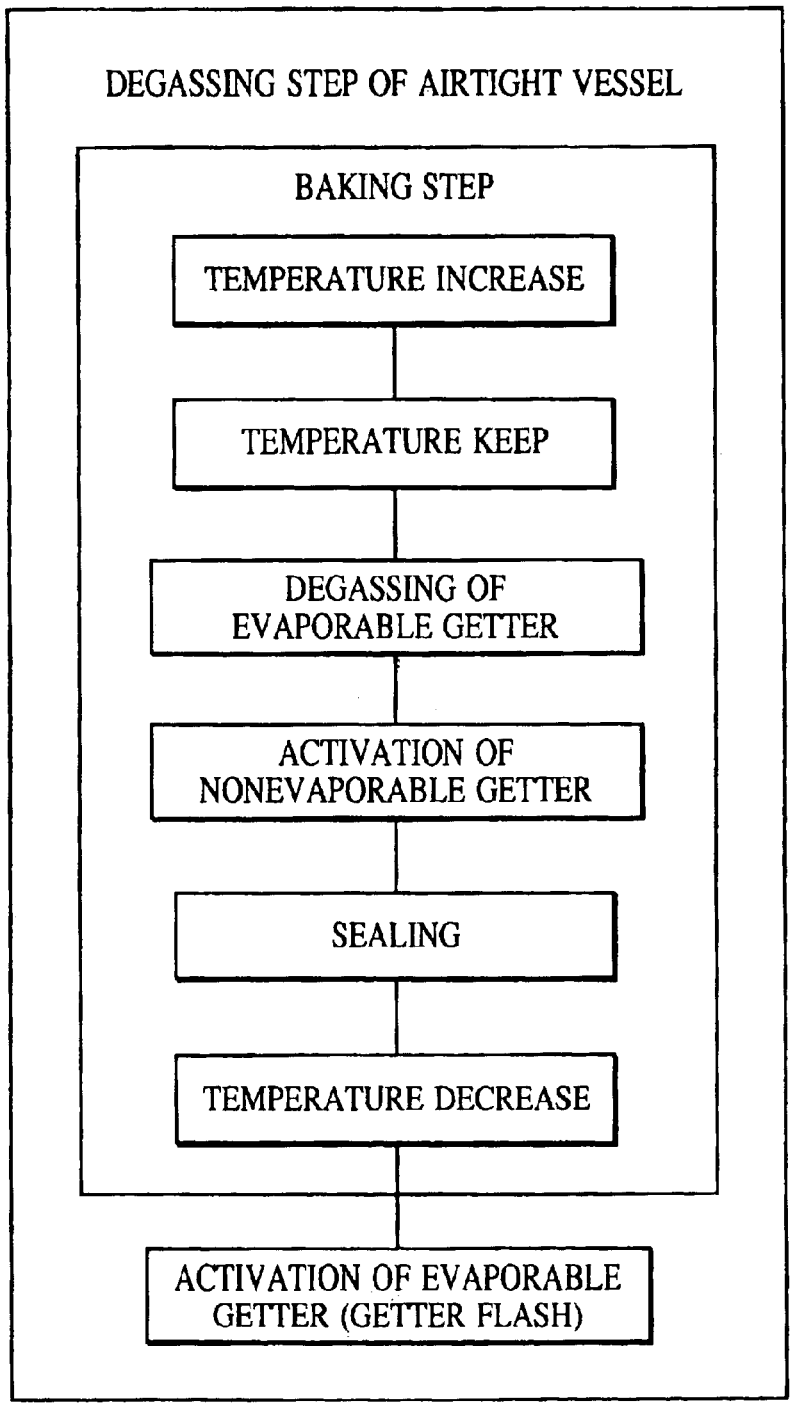
FIG. 18 shows a flow chart of the degassing step in Example 5.

Step J (degassing and airtight sealing steps of vessel):

The vessel was subjected to degassed and airtight seal steps according to the process shown in FIG. 18.

(D-1) The evacuation tubes 11 and 12 were connected to the vacuum pump (not shown in the drawing) to sufficiently evacuate the inside of the vessel. Then, evacuation of the vessel was continued while allowing the temperature of the entire vessel including the evacuation tubes 11 and 12 to increase from room temperature at a heating rate of 2° C. per minute.

(D-2) Evacuation was continued after the temperature of the entire vessel had reached to 300° C. by maintaining the temperature. While the vessel was heated and evacuated, the Ba getter as an evaporable getter was heated with microwave so as not to cause getter flash (evaporation and deposition of Ba). The getter is heated in order to previously remove the gases that will be discharged when the evaporable getter is activated. While the Ba getter was degassed by heating with microwave, any appropriate heating means such as laser irradiation may be used.

The evaporable getter is degassed before the succeeding activation step of the nonevaporable getter in order to prevent the life span of the nonevaporable getter from being shortened by allowing the gases discharged from the evaporable getter to be eliminated by the activated nonevaporable getter.

Although the baking temperature was adjusted to 300° C. in this example as in Example 4, the baking temperature according to the present invention is not limited to 300° C. as will be evident from the foregoing descriptions.

(D-3) In the next step, the nonevaporable getter was activated at 750° C. by flowing an electric current through the electric current input-output terminals 2 and 3 of the nonevaporable getter 1 while heating the airtight vessel at 300° C. with evacuation.

(D-4) After further evacuating the vessel with heating at 300° C., parts of the evacuation tubes 11 and 12 were fused while continuing heating and evacuation to seal (chip-off) the tubes, thereby forming an airtight vessel the inside of which is spatially shut down from outside by isolating the vessel connected to the vacuum pump via the evacuation tubes 11 and 12 from the vacuum pump.

(D-5) After completing the sealing step, the airtight vessel was cooled to room temperature at a cooling rate of 2° C. per minute.

(D-6) The Ba getter as an evaporable getter was then activated (getter flash) by heating with microwave.

The evaporable getter is activated (getter flash) at room temperature as described above in order to prevent the function of the getter from being lost due to coagulation of the Ba film after deposition.

Although the evaporable getter was activated (getter flash) after the airtight vessel had been cooled to room temperature, getter flash may be applied at any stage after sealing provided that the Ba film is not coagulated.

Using the airtight vessel according to this example the evacuation tubes 11 and 12 of which had been sealed, scanning signals generated by signal generation means (not shown in the drawing) were impressed on Dox1 to Doxm projected out of the vessel and modulation signals were impressed on Doy1 to Doym projected out of the vessel to allow electrons to emit from each electron emission element. A high voltage of 5 kV was simultaneously impressed on the metal back 29 trough the high voltage terminal Hv to allow emitted electron beams to collide with the fluorescent film 28 after acceleration, thereby forming images by excitation and light emission of the fluorescent film.

The image-forming apparatus according to this example manufactured by the steps as hitherto described can form stable and high quality images having sufficient luminance for use in television for a long period of time.

Since stability of the cold cathode is influenced by the vacuum atmosphere in the airtight vessel, gases such as water and oxygen that adversely affect stability of the cold cathode should be reduced as much as possible. Deterioration of the element ascribed to the deteriorating gases discharged in the sealing step can be suppressed in the present invention by activating the nonevaporable getter along with accelerating the degassing effect of the inside of the airtight vessel during the baking step. The vessel is sealed in the present invention while the nonevaporable getter is activated besides heating the vessel at a high temperature, thereby effectively evacuating the deteriorating gases discharged in the sealing step and invading into the airtight vessel.

Keeping the vessel at a high temperature allows the adsorption time of the deteriorating gases onto the inner wall of the vessel to be largely shortened along with more promptly eliminating the deteriorating gases since the adsorption characteristics of the nonevaporable getter is improved by several times.

Accordingly, the present invention provides an image-display device with a long life span, making it possible to maintain the electron emission characteristics stable for a long period of time by activating the getter before sealing and by sealing the vessel at a high temperature.

What is claimed is:

1. A method for manufacturing an airtight vessel, comprising the steps of:

a) fabricating an airtight vessel connected to an evacuation tube;

b) evacuating the inside of the airtight vessel through the evacuation tube;

c) activating a non-evaporable getter disposed in the airtight vessel by selective heating before baking the airtight vessel;

d) baking the entire airtight vessel and sealing the evacuation tube; and e) after baking the entire airtight vessel, reactivating the non-evaporable getter.

* * * * *